US007997671B2

(12) United States Patent
Ishizaki

(10) Patent No.: US 7,997,671 B2
(45) Date of Patent: Aug. 16, 2011

(54) CAPACITIVE LOAD DRIVING CIRCUIT AND METHOD, LIQUID DROPLET EJECTION DEVICE, AND PIEZOELECTRIC SPEAKER DRIVING DEVICE

(75) Inventor: Sunao Ishizaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/882,569

(22) Filed: Sep. 15, 2010

(65) Prior Publication Data

US 2011/0002486 A1 Jan. 6, 2011

Related U.S. Application Data

(62) Division of application No. 11/349,399, filed on Feb. 6, 2006, now Pat. No. 7,850,265.

(30) Foreign Application Priority Data

Sep. 26, 2005 (JP) ..... 2005-278806

(51) Int. Cl.
*B41J 29/38* (2006.01)
*B41J 2/045* (2006.01)

(52) U.S. Cl. ..... 347/9; 347/10; 347/68

(58) Field of Classification Search ..... 347/9, 10, 347/68

See application file for complete search history.

(56) References Cited

U.S. PATENT DOCUMENTS

| | | | | |
|---|---|---|---|---|
| 6,454,377 | B1 | 9/2002 | Ishizaki | |
| 6,762,645 | B1 | 7/2004 | Grant | |
| 7,244,007 | B2 | 7/2007 | Ishizaki | |
| 2003/0194970 | A1 | 10/2003 | Hoyt et al. | |
| 2003/0194971 | A1 | 10/2003 | Hoyt et al. | |
| 2005/0231179 | A1 | 10/2005 | Ishizaki | |
| 2006/0119700 | A1 * | 6/2006 | Harris et al. | 347/237 |
| 2008/0024099 | A1 | 1/2008 | Oki et al. | |

FOREIGN PATENT DOCUMENTS

| | | |
|---|---|---|
| JP | 11-020151 | 1/1999 |
| JP | 11-020155 | 1/1999 |
| JP | 2940542 | 6/1999 |
| JP | 11-205050 | 7/1999 |
| JP | 2000-196376 | 7/2000 |
| JP | 2000-513159 | 10/2000 |
| JP | 3223891 | 8/2001 |
| JP | 2002-359525 | 12/2002 |
| JP | 2004-283477 | 10/2004 |
| JP | 3601450 | 10/2004 |

(Continued)

*Primary Examiner* — Matthew Luu
*Assistant Examiner* — Jannelle M Lebron
(74) *Attorney, Agent, or Firm* — Fildes & Outland, P.C.

(57) ABSTRACT

There is provided a capacitive load driving circuit which applies a driving signal to a capacitive load. The driving circuit includes: an operational amplifier outputting a difference signal between signals from an inverting input terminal and a non-inverting input terminal, and setting a loop gain; a pulse width modulator pulse-width-modulating the difference signal outputted by the operational amplifier, and outputting resultant digital signal; a digital voltage amplifier amplifying a voltage of the digital signal; a first filter smoothing a digital signal from the digital voltage amplifier, and supplying a smoothed signal to the capacitive load as the driving signal; an impedance converting circuit converting an impedance of an output signal of the first filter; and a first feedback circuit feeding-back the driving signal, which is outputted from the first filter, to the inverting input terminal of the operational amplifier via the impedance converting circuit.

6 Claims, 11 Drawing Sheets

FOREIGN PATENT DOCUMENTS

| | | |
|---|---|---|
| JP | 2005-035001 | 2/2005 |
| JP | 2005-210280 | 8/2005 |
| JP | 2005-329710 | 12/2005 |
| WO | 2005088816 | 9/2005 |

* cited by examiner

CAPACITIVE LOAD DRIVING CIRCUIT AND METHOD, LIQUID DROPLET EJECTION DEVICE, AND PIEZOELECTRIC SPEAKER DRIVING DEVICE

CROSS-REFERENCE TO RELATED APPLICATIONS

This application is a division of U.S. application Ser. No. 11/349,399 filed Feb. 6, 2006, which claims priority under 35 USC 119 from Japanese Patent Application No. 2005-278806, the disclosure of which is incorporated by reference herein.

BACKGROUND OF THE INVENTION

1. Field of the Invention

The present invention relates to a capacitive load driving circuit and method, a liquid droplet ejection device, and a piezoelectric speaker driving device, and in particular, to a capacitive load driving circuit and method, a liquid droplet ejection device, and a piezoelectric speaker driving device which stably operate a capacitive load.

2. Description of the Related Art

A driving circuit of an inkjet head outputs an analog driving signal to a piezoelectric element for ejecting an ink droplet from a nozzle of the inkjet head, and thereby causes an ink droplet to be ejected from the nozzle which is provided so as to correspond to that piezoelectric element. A piezoelectric actuator is a capacitive load, and there are the following three problems in driving it.

First, the driving circuit is an analog amplifying circuit (a Class B amplifying circuit). Therefore, there is the problem that, if a large number of nozzles are driven simultaneously, a large amount of heat is generated and the energy efficiency is poor (30 to 40%). Second, if there are many nozzles which are driven simultaneously, the impedance of the load decreases and the waveform becomes weak (dull). As a result, the jetting characteristics of the head are affected. Third, in terms of packaging, a large heat sink is needed in order to dissipate heat. Therefore, at the time of realizing high-speed printing by using a large number of nozzles, there are the problems that the packaging surface area increases and costs increase.

Thus, there has been proposed a driving waveform generating device for an inkjet print head which stores, in advance, a waveform data group for generating driving waveforms, selectively reads-out at least one waveform data to be used from among this waveform data group, carries out a predetermined arithmetic processing on the waveform data which is read-out, prepares a driving waveform, subjects the signal of this driving waveform to D/A conversion, and then amplifies and outputs it (see, for example, Japanese Patent No. 2940542).

There has also been proposed a driving circuit of an inkjet recording head, which the driving circuit is equipped with: storage means for storing driving waveform information for generating a driving waveform signal for each ink droplet diameter; plural waveform controlling means provided for the respective ink droplet diameters, and reading-out, from the storage means, driving waveform information corresponding to configurations of driving waveform signals which are to be generated, and successively outputting the information; plural waveform generating means which are provided for the respective ink droplet diameters, and which, after subjecting the driving waveform information, which is successively outputted from the waveform controlling means, to analog conversion, carry out integration processing so as to generate corresponding driving waveform signals; and driving means selecting, in accordance with the value of printing data, one driving waveform signal from among the plural driving waveform signals outputted from the plural waveform generating means, and applying it to a piezoelectric element (refer to Japanese Patent No. 3223891 for example).

Further, there have also been proposed head driving devices for recording devices in which a switching circuit for selecting a head driving channel, and an electric power amplifier, which supplies to this switching circuit electric power which drives the head, are connected by a wiring material (see, for example, Japanese Patent Applications Laid-Open Nos. 11-020151 and 11-020155).

In the head driving device for a recording device of JP-A No. 11-020151, the electric power amplifier has a negative feedback circuit. This negative feedback circuit leads a signal wire for negative feedback out from an input terminal of the switching circuit to the electric power amplifier, and the transmission system of the wiring material is inserted in the negative feedback loop. Further, in the head driving device for a recording device of JP-A No. 11-020155, the electric power amplifier has a feedback circuit. This feedback circuit leads signal wires for feedback out to the electric power amplifier from the ground point and from the point where one switch of the switching circuit and one channel of the head are connected. This switch is inserted in the feedback loop.

There is also proposed an inkjet head driving circuit (refer to Japanese Patent No. 3601450 for example) having a waveform generating circuit which generates a driving waveform signal, and an electric power amplifying circuit which, with the driving waveform signal being one input thereof, amplifies the driving waveform signal and outputs it to a piezoelectric element. In this circuit a feedback signal, which feedsback the terminal voltage of the piezoelectric element, and an output signal from the electric power amplifying circuit are collectively the other input of the electric power amplifying circuit.

All of the above-described techniques can for the most part overcome the above-described first and second problems. However, they cannot overcome the third problem of the packaging surface area increasing due to the generation of heat.

SUMMARY OF THE INVENTION

The present invention has been made in view of the above circumstances, and provides a capacitive load driving circuit and method, a liquid droplet ejection device, and a piezoelectric speaker driving device which can stably drive a capacitive load while keeping the packaging surface area in check.

An aspect of the present invention provides a capacitive load driving circuit which applies a driving signal to a capacitive load and drives the capacitive load, the capacitive load driving circuit including: an operational amplifier outputting a difference signal of a signal inputted to an inverting input terminal and an analog driving signal inputted to a non-inverting input terminal, and setting a loop gain; a pulse width modulator pulse-width-modulating the difference signal outputted by the operational amplifier, and outputting resultant digital signal; a digital voltage amplifier amplifying a voltage of the digital signal; a first filter smoothing a digital signal outputted by the digital voltage amplifier, and supplying a smoothed signal to the capacitive load as the driving signal; an impedance converting circuit converting an impedance of an output signal of the first filter; and a first feedback circuit feeding-back the driving signal, which is outputted from the first filter, to the inverting input terminal of the operational amplifier via the impedance converting circuit.

Another aspect of the present invention provides a liquid droplet ejection device having a liquid droplet ejection head which includes a plurality of pressure generating chambers filled with liquid to be ejected from nozzles, and a plurality of piezoelectric elements provided so as to correspond to the respective pressure generating chambers, the liquid droplet ejection device causing liquid droplets to be ejected from the pressure generating chambers by applying a driving signal to the piezoelectric elements and deforming capacities of the pressure generating chambers, the liquid droplet ejection device including: a piezoelectric element driving circuit, the driving circuit including: an operational amplifier outputting a difference signal of a signal inputted to an inverting input terminal and an analog driving signal inputted to a non-inverting input terminal, and setting a loop gain; a pulse width modulator pulse-width-modulating the difference signal outputted by the operational amplifier, and outputting a digital signal; a digital voltage amplifier amplifying a voltage of the digital signal; a first filter smoothing a digital signal outputted by the digital voltage amplifier, and supplying a smoothed signal to the piezoelectric elements as the driving signal; an impedance converting circuit converting an impedance of an inputted signal; and a first feedback circuit feeding-back the driving signal, which is outputted from the first filter, to the inverting input terminal of the operational amplifier via the impedance converting circuit.

Another aspect of the present invention provides a piezoelectric speaker driving device applying a driving signal to a piezoelectric speaker and driving the piezoelectric speaker, the piezoelectric speaker driving device including: an operational amplifier outputting a difference signal of a signal inputted to an inverting input terminal and an analog driving signal inputted to a non-inverting input terminal, and setting a loop gain; a first pulse width modulator pulse-width-modulating the difference signal outputted by the operational amplifier, and outputting resultant digital signal; a first digital voltage amplifier amplifying a voltage of the digital signal outputted from the first pulse width modulator; a first filter smoothing a digital signal outputted by the first digital voltage amplifier, and supplying a smoothed signal to one polarity of the piezoelectric speaker as a first driving signal; a second pulse width modulator pulse-width-modulating an inverted signal of the difference signal outputted by the operational amplifier, and outputting resultant digital signal; a second digital voltage amplifier amplifying a voltage of the digital signal outputted from the second pulse width modulator; a second filter smoothing a digital signal outputted by the second digital voltage amplifier, and supplying a smoothed signal to another polarity of the piezoelectric speaker as a second driving signal; and a differential amplifier outputting a differential amplification of the first and second driving signals outputted from the first and second filters, and supplying it to the inverting input terminal of the operational amplifier.

BRIEF DESCRIPTION OF THE DRAWINGS

Embodiments of the present invention will be described in detail based on the following figures, wherein.

DETAILED DESCRIPTION OF THE INVENTION

Embodiments of the present invention will be described in detail hereinafter with reference to the drawings. In the first through fourth embodiments, description will be given by using, as an example, a liquid droplet ejection device which ejects liquid droplets. Although not illustrated, the liquid droplet ejection device has a head including plural pressure generating chambers filled with liquid to be ejected from nozzles, and plural piezoelectric actuators provided so as to correspond to the respective pressure generating chambers. By applying driving signals to the piezoelectric actuators and changing the capacities of the pressure generating chambers, liquid droplets are ejected from the head. Note that the liquid droplet ejection device can be applied to an inkjet device or a semiconductor pattern forming device.

First Embodiment

Figure 1:
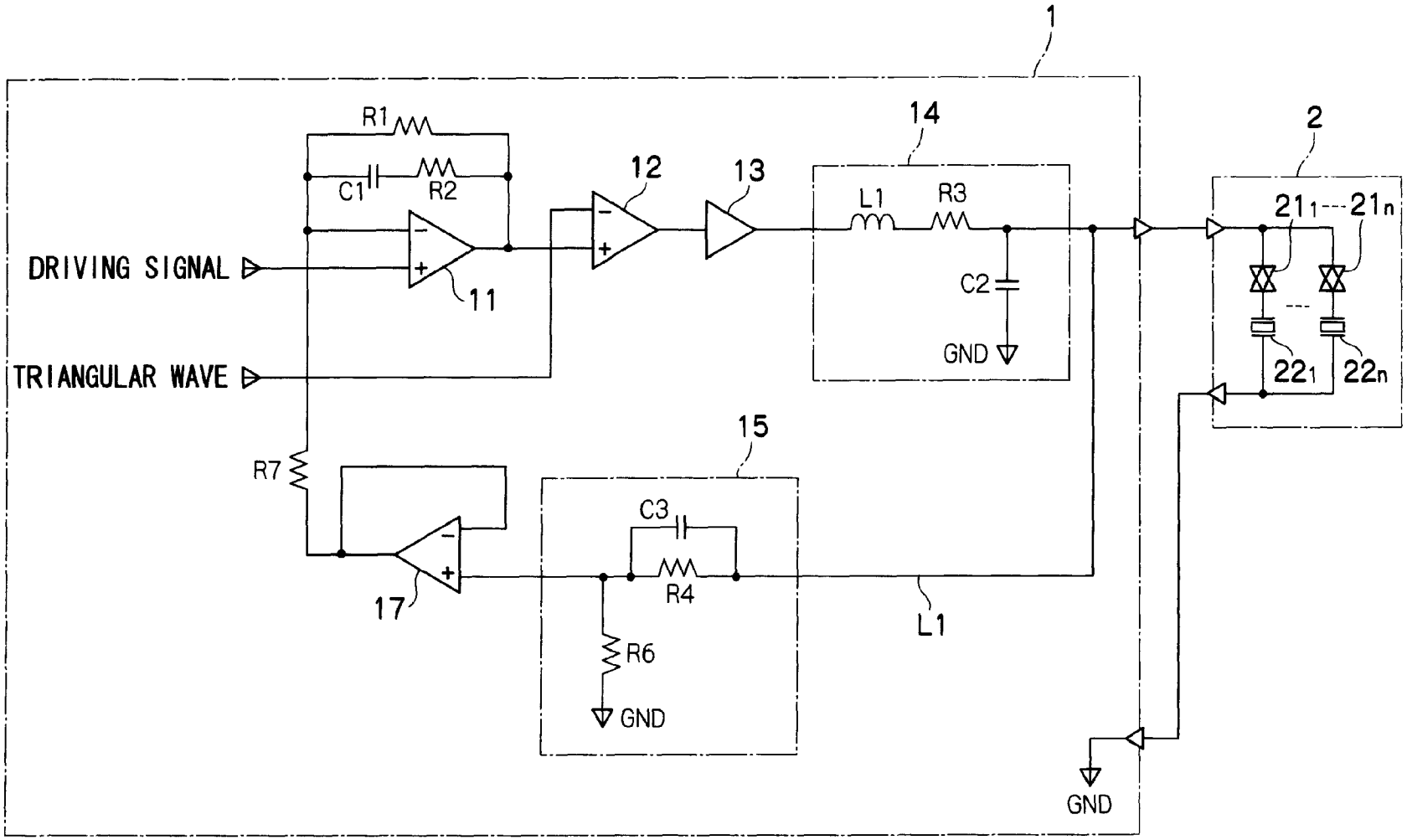
FIG. 1 is a diagram showing a circuit structure of a liquid droplet ejection device relating to a first embodiment.

FIG. 1 is a diagram showing the circuit structure of a liquid droplet ejection device relating to a first embodiment. The liquid droplet ejection device has a driving circuit board 1 and a head 2. An operational amplifier 11, a comparator 12, a digital voltage amplifier 13, and a first filter 14 are provided at the driving circuit board 1.

(Overall Structure 1)

The head 2 has n (where n is a natural number) transfer gates $\mathbf{21}_1$ through $\mathbf{21}_n$, and $n$ piezoelectric actuators $\mathbf{22}_1$ through $\mathbf{22}_n$ which are connected in series to the transfer gates $\mathbf{21}_1$ through $\mathbf{21}_n$ respectively.

An analog driving signal is inputted to the non-inverting input terminal of the operational amplifier 11. The output terminal of the operational amplifier 11 is connected to the non-inverting input terminal of the comparator 12 which structures a pulse width modulator. Further, the output terminal of the operational amplifier 11 is connected to the inverting input terminal of the operational amplifier 11, via a series circuit structured by a resistor R2 and a capacitor C1. A resistor R1 is connected in parallel to the series circuit structured by the resistor R2 and the capacitor C1.

The capacitor C1 and the resistor R1 work to lower the gain of the operational amplifier 11 in the high-frequency band. In this way, the band is not extended more than necessary and made unstable. The resistor R2 controls the gain such that that output of the operational amplifier 11 does not exceed the same-phase input range of the comparator 12. However, if the value of the resistor R2 is too small, the open loop gain decreases too much, and steady deviation (offset) arises in the output of the piezoelectric actuator 22. Accordingly, in determining these values, there is a trade-off between the two.

A triangular wave is inputted to the inverting input terminal of the comparator 12, and the output signal of the operational amplifier 11 is inputted to the non-inverting input terminal. The comparator 12 is a pulse width modulator. When the voltage of the error signal inputted to the non-inverting input terminal is higher than the voltage of the triangular wave inputted to the inverting input terminal, the comparator 12 outputs a high-level signal, whereas when it is lower, the comparator 12 outputs a low-level signal. The output terminal of the comparator 12 is connected to the input terminal of the digital voltage amplifier 13.

(Structure of Digital Voltage Amplifier 13)

Figure 2:
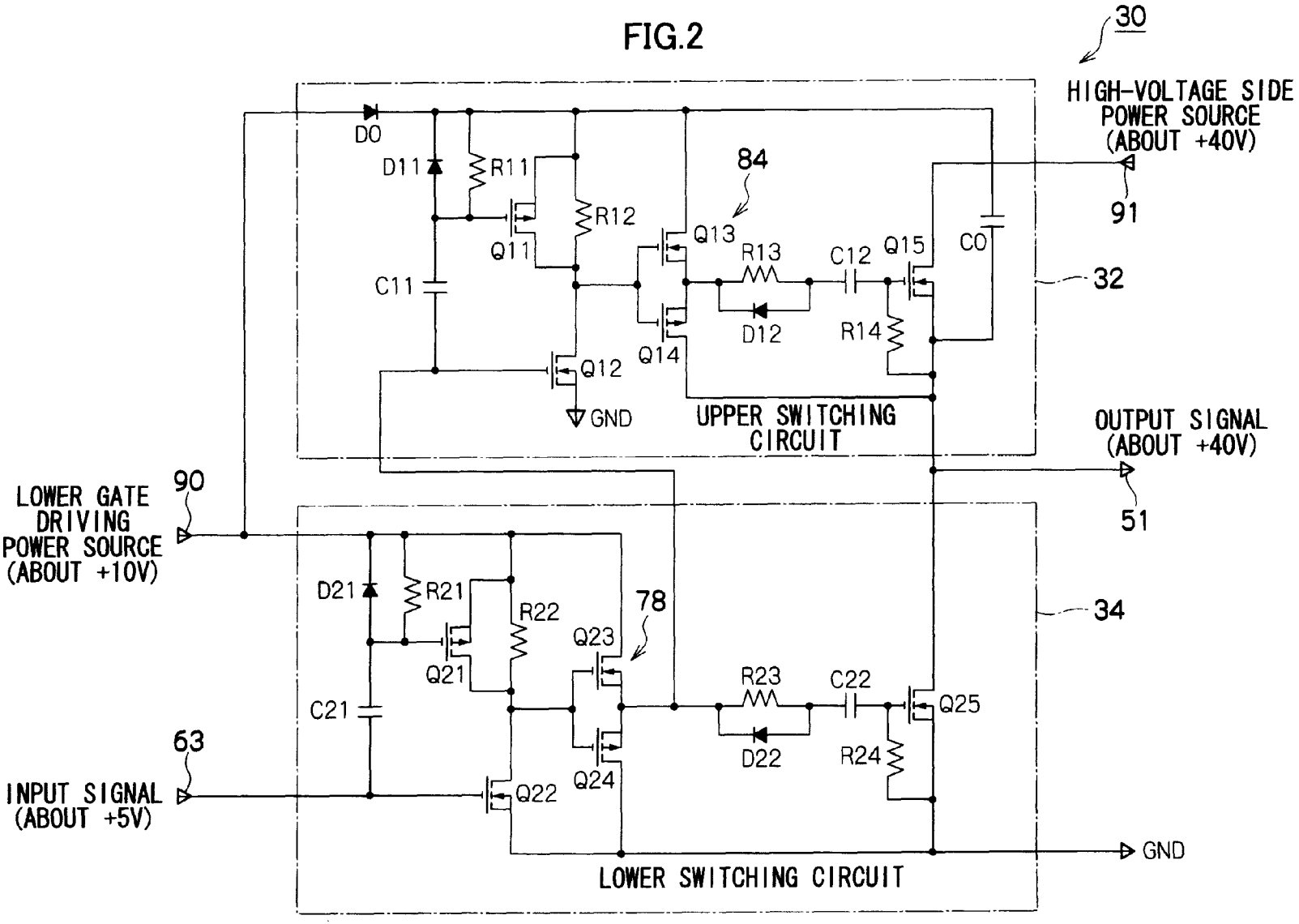
FIG. 2 is a diagram showing a circuit structure of digital voltage amplifier.

FIG. 2 is a diagram showing the circuit structure of the digital voltage amplifier 13. The digital voltage amplifier 13 has an upper switching circuit 32 and a lower switching circuit 34.

The upper switching circuit 32 has diodes D0, D11, D12, capacitors C11, C12, resistors R11, R12, R13, R14, P-channel MOSFETs Q11, Q14, and N-channel MOSFETs Q12, Q13, Q15.

The lower switching circuit 34 has capacitors C21, C22, diodes D21, D22, resistors R21, R22, R23, R24, P-channel MOSFETs Q21, Q24, and N-channel MOSFETs Q22, Q23, Q25.

(Structure of Lower Switching Circuit 34)

The gate of the MOSFET Q22 is connected to the output terminal of the comparator 12 via an input signal terminal 63, and the source is grounded. The drain of the MOSFET Q22 is connected, via the resistor R22, to a lower gate driving power source terminal 90 which is for driving the lower switching circuit 34.

The drain of the MOSFET Q21 is connected to the lower gate driving power source terminal 90. The source of the MOSFET Q21 is connected to the drain of the MOSFET Q22.

The gate of the MOSFET Q21 is connected to the anode of the diode D21. The cathode of the diode D21 is connected to the lower gate driving power source terminal 90. Further, the gate of the MOSFET Q21 is connected to the lower gate driving power source terminal 90 via the resistor R21, and is connected to the input signal terminal 63 via the capacitor C21.

The gates of the MOSFETs Q23, Q24 are connected to one another, and structure a push-pull buffer circuit 78. The drain of the MOSFET Q23 is connected to the lower gate driving power source terminal 90, and the source is connected to the drain of the MOSFET Q24. The source of the MOSFET Q24 is grounded.

Therefore, the gates of the MOSFETs Q23, Q24 are the input terminals of the push-pull buffer circuit 78. The source of the MOSFET Q23 and the drain of the MOSFET Q24 are the output terminals of the push-pull buffer circuit 78. The input terminals of the push-pull buffer circuit 78 are connected to the lower gate driving power source terminal 90 via the resistor R22.

The output terminals of the buffer circuit 78 are connected to the gate of the MOSFET Q25 via a parallel circuit, which is structured by the resistor R23 and the diode D22, and the capacitor C22. Note that the cathode of the diode D22 is connected to the output terminals of the push-pull buffer circuit 78, and the anode thereof is connected to the capacitor 22. The source of the MOSFET Q25 is grounded, and the drain is connected to an output terminal 51. The gate of the MOSFET Q25 is grounded via the resistor R24.

(Structure of Upper Switching Circuit 32)

The upper switching circuit 32 is structured substantially similarly to the lower switching circuit 34. Therefore, description of detailed structures of the upper switching circuit 32 will be omitted, and the connection relationships which differ from the lower switching circuit 34 will mainly be described.

Note that the capacitors C11, C12, the diodes D11, D12, the resistors R11, R12, R13, R14, and the MOSFETs Q11, Q12, Q13, Q14 of the upper switching circuit 32 respectively correspond to the capacitors C21, C22, the diodes D21, D22, the resistors R21, R22, R23, R24, and the MOSFETs Q21, Q22, Q23, Q24 of the lower switching circuit 34. A push-pull buffer circuit 84 structured by the MOSFET Q13 and the MOSFET Q14 corresponds to the push-pull buffer circuit 78.

The gate of the MOSFET Q12 is connected not to the input signal terminal 63, but rather to the output terminal of the push-pull buffer circuit 78. The source of the MOSFET Q12 is grounded. The sources of the MOSFETS Q14, Q15 are connected to the output terminal 51. The drain of the MOSFET Q15 is connected to a high-voltage side power source terminal 91 which is for amplifying current.

The cathode of the diode D11, the resistors R11, R12, and the drain of the MOSFET Q13 are respectively connected via the diode D0 to the lower gate driving power source terminal 90. Note that the anode of the diode D0 is connected to the lower gate driving power source terminal 90. Further, the lower gate driving power source terminal 90 is connected to the source of the MOSFET Q15 via the diode D0 and a capacitor C0.

(Overall Structure 2)

As shown in FIG. 1, the output terminal of the digital voltage amplifier 13 is connected to the first filter 14. The first filter 14 has an inductor L1 which is connected to the output terminal of the digital voltage amplifier 13, a resistor R3 which is connected to the output side of the inductor L1, and a capacitor C2 whose one end is connected to the output side of the resistor R3 and whose other end is grounded. The first filter 14 functions as a low-pass filter which smoothes the signal inputted to the inductor L1 and outputs it from the resistor R3. Further, the first filter 14 has two elements which damp the high-frequency band: the inductor L1, and the circuit which is formed from the resistor R3 and the capacitor C2. Thus, the first filter 14 is a secondary delay element.

The output terminal of the first filter 14 is connected to the respective transfer gates $\mathbf{21}_1$ through $\mathbf{21}_n$ of the head 2. The n transfer gates $\mathbf{21}_1$ through $\mathbf{21}_n$ are connected to the n piezoelectric actuators $\mathbf{22}_1$ through $\mathbf{22}_n$ which correspond to the respective transfer gates 21. The other end sides of the piezoelectric actuators $\mathbf{22}_1$ through $\mathbf{22}_n$ are grounded.

The output terminal of the first filter 14 is connected to the inverting input terminal of the operational amplifier 11 via a first feedback circuit 15, an operational amplifier 17, and a resistor R7. The first feedback circuit 15 has a capacitor C3 and a resistor R4 which are connected in parallel, and a resistor R6 whose one end is connected to the output side of the resistor R4 and whose other end is grounded. The resistors R4 and R6 divide the output voltage of the first filter 14 (the terminal voltage of the piezoelectric actuators 22). Further, the parallel circuit of the capacitor C3 and the resistor R4 carries out phase adjustment of the output terminal of the first filter 14.

The inverting input terminal of the operational amplifier 17 is connected to the output terminal. The non-inverting input terminal of the operational amplifier 17 is connected to the output side of the first feedback circuit 15 (the output side of the resistor R4). Therefore, the operational amplifier 17 functions as an impedance converting circuit whose voltage gain is "1".

Here, the values of the capacitor C3 and the resistors R4, R6 of the first feedback circuit 15 affect the determination of the values of the resistors R1, R2 and the capacitor C1 which are connected to the operational amplifier 11. Accordingly, depending on the constants of the first feedback circuit 15, there are cases in which it is difficult to ensure a sufficient open loop gain.

However, the operational amplifier 17 is an impedance converting circuit, and is a so-called buffer circuit which buffers the first feedback circuit 15 and the operational amplifier 11 circuit. In this way, all of the constants of the first feedback circuit 15 and the constants of C1, R1, R2 of the operational amplifier 11 circuit can be set independently, and a sufficient open loop gain can be ensured. As a result, it is possible to structure a circuit which has no steady deviation and whose following ability is good.

Further, because the piezoelectric actuators $\mathbf{22}_1$ through $\mathbf{22}_n$ are connected in parallel to the first filter 14, the cut-off frequency of the first filter 14 changes. However, because the first filter 14 and the piezoelectric actuators $\mathbf{22}_1$ through $\mathbf{22}_n$ are in the closed loop, fluctuations in the cut-off frequency can be suppressed.

(Operation of Liquid Droplet Ejection Device)

As shown in FIG. 1, the operational amplifier 11 outputs, to the non-inverting input terminal of the comparator 12, the error signal of the analog driving signal inputted to the non-inverting input terminal and the signal in which the terminal voltage of the piezoelectric actuators 22 is fed-back via the first feedback circuit 15, the operational amplifier 17, and the resistor R7.

The comparator 12 carries out pulse width modulation on the basis of the error signal of the operational amplifier 11 inputted to the non-inverting input terminal, and the triangular wave inputted to the inverting input terminal. Then, the comparator 12 outputs, to the digital voltage amplifier 13, a digital signal of a duty ratio corresponding to the fluctuation in voltage of the error signal inputted to the non-inverting input terminal.

Therefore, if the terminal voltage of the piezoelectric actuators 22 rises, the level of the error signal of the operational amplifier 11 falls. Further, the duty ratio of the digital signal outputted from the comparator 12 falls, and the terminal voltage of the piezoelectric actuators 22 also falls. Namely, the comparator 12 effects control such that the voltage of the error signal of the operational amplifier 11 becomes 0.

The digital voltage amplifier 13 amplifies the voltage and the current of the digital signal which the comparator 12 outputted, so as to become an electric power (e.g., a voltage from about 20 V to 40 V) which can drive the piezoelectric actuators 22 by a switching operation. The first filter 14 smoothes the output from the digital voltage amplifier 13, and outputs it to the respective transfer gates $\mathbf{21}_1$ through $\mathbf{21}_n$ of the head 2.

The driving signal whose electric power has been amplified is inputted to the respective transfer gates $\mathbf{21}_1$ through $\mathbf{21}_n$, and voltage corresponding to the image data is applied to the respective transfer gates $\mathbf{21}_1$ through $\mathbf{21}_n$. Driving voltage is thereby applied to the piezoelectric actuators $\mathbf{22}_1$ through $\mathbf{22}_n$ which are correspondingly connected to the transfer gates $\mathbf{21}_1$ through $\mathbf{21}_n$.

Because the respective piezoelectric actuators $\mathbf{22}_1$ through $\mathbf{22}_n$ are capacitive loads, there is the concern that the cut-off frequency of the first filter 14 will fluctuate in accordance with fluctuations in the number of the piezoelectric actuators $\mathbf{22}_1$ through $\mathbf{22}_n$ which are driven simultaneously in accordance with the image data. In detail, the capacitor C2 which structures the first filter 14, and the piezoelectric actuators $\mathbf{22}_1$ through $\mathbf{22}_n$ which are capacitive loads, are parallel. Therefore, if the number of the piezoelectric actuators $\mathbf{22}_1$ through $\mathbf{22}_n$ which are driven simultaneously fluctuates, the load of the first filter 14 fluctuates, and there is the possibility that the cut-off frequency will fluctuate.

However, the signal outputted from the first filter 14 (the terminal voltage of the piezoelectric actuators 22) is fed-back to the inverting input terminal of the operational amplifier 11 via the first feedback circuit 15 and the operational amplifier 17. Accordingly, fluctuations in the cut-off frequency of the first filter 14 can be suppressed. Moreover, by suppressing fluctuations in the cut-off frequency of the first filter 14, the terminal voltage of the piezoelectric actuators $\mathbf{22}_1$ through $\mathbf{22}_n$ can be compensated in order to be substantially uniform.

(Operation of Digital Voltage Amplifier 13)

The driving signal for driving each of the piezoelectric actuators $\mathbf{22}_1$ through $\mathbf{22}_n$ is in a frequency band of from 100 KHz to 1 MHz. In order to carry out, at the digital voltage amplifier 13, a switching operation at such a frequency, a sampling frequency of about 10 MHz is needed. Accordingly, the digital voltage amplifier 13 carries out high-speed switching operation at 10 nsec.

(When the Input Signal is High-Level)

When the digital signal inputted via the input terminal 63 is high-level, at the MOSFET Q22 of the lower switching circuit 34, the gate voltage is high with respect to the source voltage, and therefore, the MOSFET Q22 is on. At this time, because the drain voltage of the MOSFET Q22 and the source voltage of the MOSFET Q25 are the same, the MOSFET Q25 is off.

Further, when the digital signal inputted from the input terminal 63 is high-level, the MOSFET Q22 of the lower switching circuit 34 is on. Therefore, a ground-level, i.e., low-level, voltage is inputted to the gate of the MOSFET Q12 of the upper switching circuit 32.

Because the source of the MOSFET Q12 is connected to the ground, the MOSFET Q12 is turned off. When the MOSFET Q12 is off, power source voltage is inputted from the lower gate driving power source terminal 90 to the source of the MOSFET Q15. In a state in which absolutely no charges are stored in the capacitor C0, the gate voltage of the MOSFET Q15 is large with respect to the source voltage thereof, and therefore, the MOSFET Q15 is on.

Therefore, when the digital signal inputted from the input terminal 63 is high-level, the MOSFET Q15 of the upper switching circuit 32 is on, and the MOSFET Q25 of the lower switching circuit 34 is off. Thus, the upper switching circuit 32 is in a conductive state. At this time, the lower switching circuit 34 is in an open state because the MOSFET Q25 is off.

Accordingly, when the digital signal inputted to the input terminal 63 is high-level, the digital voltage amplifier 13 is overall a positive logic electric power amplifying circuit, and the upper switching circuit 32 charges the respective piezoelectric actuators $\mathbf{22}_1$ through $\mathbf{22}_n$.

(When the Input Signal is Low-Level)

When the digital signal inputted from the input terminal 63 is low-level, conversely, the MOSFET Q15 of the upper switching circuit 32 is off, and the MOSFET Q25 of the lower switching circuit 34 is on. Therefore, the lower switching circuit 34 is in a conductive state. At this time, the upper switching circuit 32 is in an open state.

Accordingly, when the digital signal inputted to the input terminal 63 is low-level, the digital voltage amplifier 13 is overall a negative logic electric power amplifying circuit, and the lower switching circuit 34 discharges the respective piezoelectric actuators $\mathbf{22}_1$ through $\mathbf{22}_n$.

In this way, the digital voltage amplifier 13 carries out voltage amplification and current amplification by using the digital technique of a switching operation. Therefore, as compared with conventional electric power amplifiers which amplify the voltage and amplify the current of analog signals, the generation of heat at the time of amplifying the electric power can be suppressed.

(Suppression of Heat Generation, and High-Speed Operation)

The series circuit, which is structured from the MOSFET Q12 and the resistor R12 of the upper switching circuit 32, is a circuit for amplifying the voltage of a digital signal, and carries out voltage amplification in accordance with the digital signal inputted from the input terminal 63.

When the digital signal inputted from the input terminal 63 is high-level, the MOSFET Q12 is off. When the MOSFET Q12 is off, the power source voltage from the lower gate driving power source terminal 90 is inputted via the resistor R12, the voltage is amplified by the series circuit structured from the resistor R12 and the MOSFET Q12, and thereafter, is outputted to the buffer circuit 84.

Here, when the digital signal inputted from the input terminal 63 changes from low-level to high-level, the MOSFET Q12 transitions from on to off. In this transitional state in which the MOSFET Q12 transitions from on to off, electric power is applied from the lower gate driving power source terminal 90 via the resistor R12 to the feedback capacitance between the gate and the drain of the MOSFET Q12. The feedback capacitance between the gate and the drain of the MOSFET Q12 at this time is substantially of the order of several pF. In order to operate the MOSFET Q12 at high speed, the value of the resistor R12 must be set to be a small value, e.g., 1 Ka However, in the transitional state in which the MOSFET Q12 transitions from on to off, when current flows from the lower gate driving power source terminal 90 via the resistor R12 to the feedback capacitance between the gate and the drain of the MOSFET Q12, there is the concern that great heat on the order of 1 W will be generated.

In order to suppress such generation of heat, the value of the resistor R12 must be made to be large. However, if the value of the resistor R12 is made to be large, it is difficult to operate the MOSFET Q12 at high speed.

Thus, in the present embodiment, the MOSFET Q11 is connected. When the digital signal inputted from the input terminal 63 is low-level, the MOSFET Q11 is on. When on, the MOSFET Q11 short-circuits resistor R12 at the path from the lower gate driving power source terminal 90 to the drain of the MOSFET Q12. Further, the value of the resistor R12 is set to be large. In the present embodiment, for example, a value which is greater than or equal to 10 KΩ is set. When the digital signal inputted from the input terminal 63 is low-level, the resistor R12 is short-circuited due to the MOSFET Q11 being on, and current flows from the lower gate driving power source terminal 90 via the resistor R11 to the drain of the MOSFET Q12.

In this way, the value of the resistor R12 is set to be large, and the MOSFET Q11, which is on when the digital signal inputted via the input terminal 63 is low-level, is provided so as to short-circuit the resistor R12. Therefore, because another bypass which does not go via the resistor R12 can be provided when the digital signal is low-level, the generation of heat can be suppressed, and the MOSFET Q12 can be operated at high speed.

Note that, when the resistance of the resistor R12 is made to be large and the MOSFET Q13 and the MOSFET Q14 are structured as bipolar transistors, supplying current to the MOSFET Q13 and the MOSFET Q14 is difficult. Therefore, in the present embodiment, the MOSFET Q13 and the MOSFET Q14 are structured by P-channel MOSFETs.

(Preventing Reverse Bias to the Lower Gate Driving Power Source Terminal 90)

When the digital signal inputted from the input terminal 63 is high-level, pinch-off voltage, which is substantially equal to the electric power supplied from the lower gate driving power source terminal 90, is applied to the capacitor C11. When the digital signal inputted from the input terminal 63 becomes low-level, because the MOSFET Q12 is on, the gate voltage of the MOSFET Q11 decreases in a short time. When the gate voltage of the MOSFET Q11 decreases in a short time, the lower terminal voltage of the capacitor C11 also decreases, and therefore, the input capacitance between the gate and the source of the MOSFET Q12 is also discharged at high speed. Thus, even if the MOSFET Q11 is structured by a P-channel MOSFET, the MOSFET Q11 can be operated at a fast speed.

Further, the anode of the diode D11 is connected to the capacitor C11, and the cathode of the diode D11 is connected to the lower gate driving power source terminal 90. Because the diode D11 is connected in this way, it is possible to prevent the gate voltage of the MOSFET Q12 from rising and reverse bias from being applied to the lower gate driving power source terminal 90.

In this way, the above-described capacitor C11, diode D11, resistor R11, MOSFET Q11, resistor R12 and MOSFET Q12, which function as the upper voltage amplifying circuit, structure a series circuit which functions as a voltage amplifying circuit which connects in series the resistor R12 and the MOSFET Q12 which is on when the digital signal inputted via the input terminal 63 is low-level, and the resistance of the resistor R12 is set to be a large value. In addition, the MOSFET Q11 is connected so as to short-circuit the resistor R12 by being on when the digital signal is low-level. Therefore, it is possible to avoid the generation of heat of a series circuit, and the MOSFET Q12 can be operated at high speed.

Further, because the gate/source capacitance of the MOSFET Q11 can be discharged at high speed by the capacitor C11, the MOSFET Q11 can be operated at a fast speed. Moreover, the application of reverse bias to the lower gate driving power source terminal 90 can be prevented by the diode D11.

(Operations of Elements of Upper Switching Circuit 32)

Next, explanation will be given of the respective operations of the MOSFET Q13, the MOSFET Q14, the resistor R13, the diode D12, the capacitor C12 and the resistor R14 of the upper switching circuit 32, as well as the operation of the MOSFET Q15 which functions as an upper switching element.

As described above, when the digital signal inputted from the input terminal 63 is high-level, the MOSFET Q12 is off, and voltage amplification is carried out by the series circuit which is structured from the resistor R12 and the MOSFET Q12. The signal whose voltage is amplified is outputted to the buffer circuit 84.

The buffer circuit 84 is a push-pull buffer circuit formed from the MOSFET Q13 and the MOSFET Q14, and amplifies the current of the signal whose voltage has been amplified.

The signal, whose voltage has been amplified and whose current has been amplified, is outputted to the gate of the MOSFET Q15 via the resistor R13 and the capacitor C12. When the digital signal inputted from the input terminal 63 is high-level, the MOSFET Q15 is on. Therefore, the signal, whose voltage has been amplified and whose current has been amplified, is outputted from the output terminal 51. As a result, the upper switching element 32 charges the piezoelectric actuators $\mathbf{22}_1$ through $\mathbf{22}_n$.

Here, it is known that the driving signal for driving each of the piezoelectric actuators $\mathbf{22}_1$ through $\mathbf{22}_n$ is in a frequency band of from several hundred KHz to 1 MHz. Thus, the digital voltage amplifier 13 must realize high-speed switching on the order of 10 nsec.

In the present embodiment, a high-speed switching operation can be carried out because an N-channel MOSFET, which operates several times faster than a P-channel MOSFET, is used as the MOSFET Q15.

Further, the MOSFET has an input capacitance between the gate and the source. Therefore, in order to operate the MOSFET Q15 at high speed, charging and discharging of the input capacitance between the gate and the source of the MOSFET Q15 must also be carried out at high speed.

In the present embodiment, the MOSFET Q13 and the MOSFET Q14, which function as a current amplifying circuit, are structured as a push-pull buffer circuit. This circuit structures a source follower, and the output impedance thereof is low. Thus, charging and discharging of the input capacitance between the gate and the source of the MOSFET Q15 can be carried out at high speed, and high-speed operation of the MOSFET Q15 can be realized.

In the present embodiment, the resistor R13 is further connected between the MOSFET Q15 and the push-pull buffer circuit which is structured from the MOSFET Q13 and the MOSFET Q14. If the charging and the discharging of the input capacitance between the gate and the source of the MOSFET Q15 is made to be too fast, a large current flows instantaneously, and therefore, there is the fear that noise will be generated. However, because the speed of the current flowing between the buffer circuit 84 and the MOSFET Q15 can be restrained by the resistor R13, the speed of charging the input capacitance between the gate and the source of the MOSFET Q15 can be restrained, and the generation of noise can be suppressed.

Here, basically, the MOSFET Q15 of the upper switching circuit 32 and the MOSFET Q25 of the lower switching circuit 34 are not on simultaneously. However, when high-speed operation of the MOSFET Q15 is realized and high-speed operation of the MOSFET Q25 of the lower current amplifying circuit of the lower switching circuit 34 which is structured similarly is realized, there is the concern that the turning-on time and the turning-off time of the MOSFET Q15 and the MOSFET Q25 will overlap. During the period of time that the turning-on time and the turning-off time of the MOSFET Q15 and the MOSFET Q25 overlap, the upper switching circuit 32 and the lower switching circuit 34 are simultaneously set in conductive states, and therefore, there is the possibility not only that malfunctioning will be caused, but also, that elements may break.

In the present embodiment, the diode D12 is connected such that the resistor R13 is short-circuited during the time of discharging the input capacitance between the gate and the source of the MOSFET Q15. Therefore, because the input capacitance of the MOSFET Q15 can discharge at high speed, the turning-on time of the MOSFET Q15 can be made to be slow and the turning-off time thereof can be made to be fast. Further, the capacitor C12 is connected between the resistor R13 and the MOSFET Q15. Therefore, the capacitor C12 and the input capacitance between the gate and the source of the MOSFET Q15 structure a series circuit. The input capacitance between the gate and the source of the MOSFET Q15 can be discharged more quickly, and the turning-off time of the MOSFET Q15 can be made to be fast.

Because the MOSFET Q15 of the upper current amplifying circuit is structured by an N-channel MOSFET in this way, the MOSFET Q15 can operate at high speed. Further, because the push-pull buffer circuit 84, which is formed from the MOSFET Q13 and the MOSFET Q14, is provided at the upper current amplifying circuit, the input capacitance between the gate and the source of the MOSFET Q15 can be charged and discharged rapidly. Moreover, the push-pull buffer circuit 84, which functions as a current amplifying circuit, is connected in series to the MOSFET Q15 via the resistor R13 and the capacitor C12. The diode D12 is also provided so as to short-circuit the resistor R13 at the time when the input capacitance of the MOSFET Q15 discharges. Therefore, the charging speed of the input capacitance of the MOSFET Q15 can be held in check, the turning-on time of the MOSFET Q15 can be made to be slow, and the turning-off time thereof can be made to be fast.

Because the turning on time of the MOSFET Q15 and the MOSFET Q25 can be made to be slow and the turning off time thereof can be made to be fast, it is possible to prevent the upper switching circuit 32 and the lower switching circuit 34 from simultaneously being set in conductive states.

Because the lower switching circuit 34 is structured similarly to the upper switching circuit 32, effects which are similar to those of the upper switching circuit 32 can be achieved.

Each of the MOSFET Q13 and the MOSFET Q14, which structure the push-pull buffer circuit 84, is structured by a MOSFET. Therefore, the input impedance, with respect to the resistor R12, of the series circuit which is structured from the MOSFET Q12 and the resistor R12 and which functions as a voltage amplifying circuit, can be increased. Accordingly, lowering of the amplification factor can be suppressed.

(Bootstrap Circuit)

A bootstrap circuit, which is structured by the capacitor C0 and the diode D0 from the lower gate driving power source terminal 90, will be described next.

The MOSFET Q15, which is provided at the upper current amplifying circuit of the upper switching circuit 32, is structured by an N-channel MOSFET. Therefore, a power source, whose voltage is higher than the source voltage, is needed for the gate driving power source of the MOSFET Q15. The high-voltage side power source terminal 91 is connected to the drain of the MOSFET Q15.

In the present embodiment, the digital signal voltage inputted from the input terminal 63 is 5V, the voltage of the lower gate driving power source terminal 90 is 10V, a digital signal of 40V, whose voltage has been amplified and whose current has been amplified, is outputted from the output terminal 51, and the voltage of the high-voltage side power source terminal 91 is 40V.

In order to drive the MOSFET Q15 of the upper current amplifying circuit, a driving power source, whose voltage is higher than the source voltage of the MOSFET Q15, must be readied as the power source for driving the MOSFET Q15 of the upper current amplifying circuit. In the present embodiment, a driving power source of about 45V is separately required. Readying such a high-voltage driving power source as the gate driving power source of the upper switching circuit 32 separately from the lower gate driving power source results in no difficulties whatsoever from a technical standpoint, but is disadvantageous in terms of costs.

Thus, in the present embodiment, the lower gate driving power source terminal 90 is connected to the source of the MOSFET Q15 via the diode D0 and the capacitor C0, and structures a bootstrap circuit. When the digital signal inputted from the input terminal 63 is low-level, the MOSFET Q25 of the lower switching circuit 34 is on, and the MOSFET Q15 of the upper switching circuit 32 is off. In this way, when the lower switching circuit 34 is in a conductive state, a loop, which reaches the capacitor C0 via the diode D0 from the lower gate driving power source terminal 90, is formed, and therefore, the capacitor C0 is charged by voltage from the lower gate driving power source terminal 90.

When the digital signal inputted from the input terminal 63 transitions from low-level to high-level, the MOSFET Q25 of the lower switching circuit 34 changes from on to off, and the MOSFET Q15 of the upper switching circuit 32 transitions from off to on. When the MOSFET Q15 starts to transition to on, the source voltage of the MOSFET Q15 rises, charges which are charged by the capacitor C0 are applied to the MOSFET Q15, and the MOSFET Q15 is set in a drivable state. When the MOSFET Q15 has transitioned completely to on, because the capacitor C0 is in a charged state, the lower terminal voltage of the capacitor C0 jumps to about 45V. Linked therewith, all of the voltages of the circuits which are being driven of the upper switching circuit 32 jump to about 45V. When the MOSFET Q15 of the upper current amplifying circuit 74 has completely transitioned to on, the charging loop of the capacitor C0, which reaches the capacitor C0 via the diode D0 from the lower gate driving power source terminal 90, disappears, and a high-level (40V) signal, whose voltage has been amplified and whose current has been amplified, is outputted from the output terminal 51.

Here, if a PNP bipolar transistor is used as the MOSFET Q11, the charges of the capacitor C11 escape via the diode D11 in the forward direction between the base and the emitter. Therefore, there is the concern that the voltage will drop and that it will no longer be possible to operate the upper switching circuit 32. However, in the present embodiment, because the MOSFET Q11 is structured by a MOSFET, this problem can be obviated.

Because the diode D0 and the capacitor C0 function as a bootstrap circuit as described above, the upper switching circuit 32 can be driven by the lower gate driving power source of the lower switching circuit 34, without separately providing a gate driving power source used exclusively for the upper switching circuit 32.

Note that the present embodiment describes a case of employing the lower gate driving power source of the lower switching circuit 34. However, if using a structure which operates, at an even lower voltage, the transistor (MOSFET) which is being used, a lower voltage, e.g., the power source voltage of a logic circuit, may be used.

(Effects)

Figure 3:
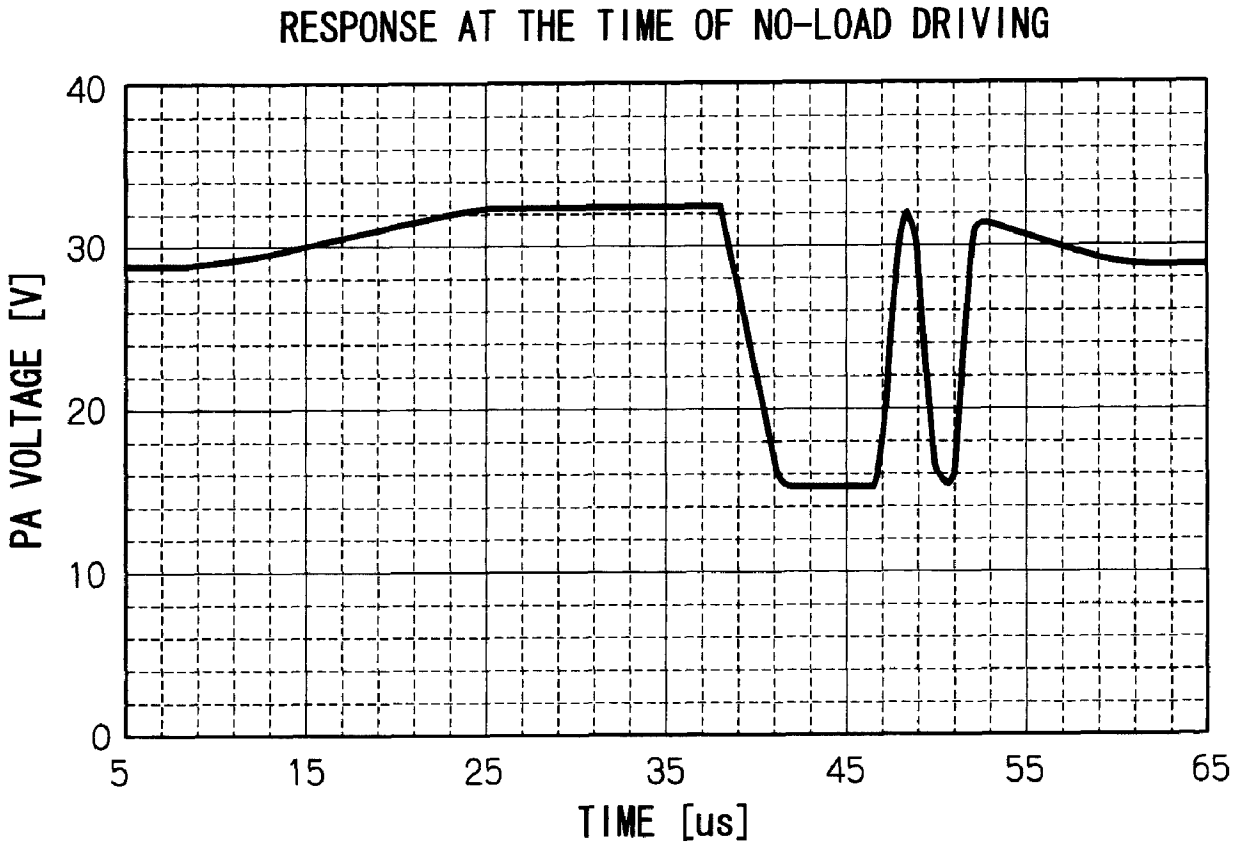
FIG. 3 is a diagram showing a driving waveform at an output terminal of a first filter 14 at the time of no-load driving which corresponds to a time of driving one piezoelectric actuator.
Figure 4:
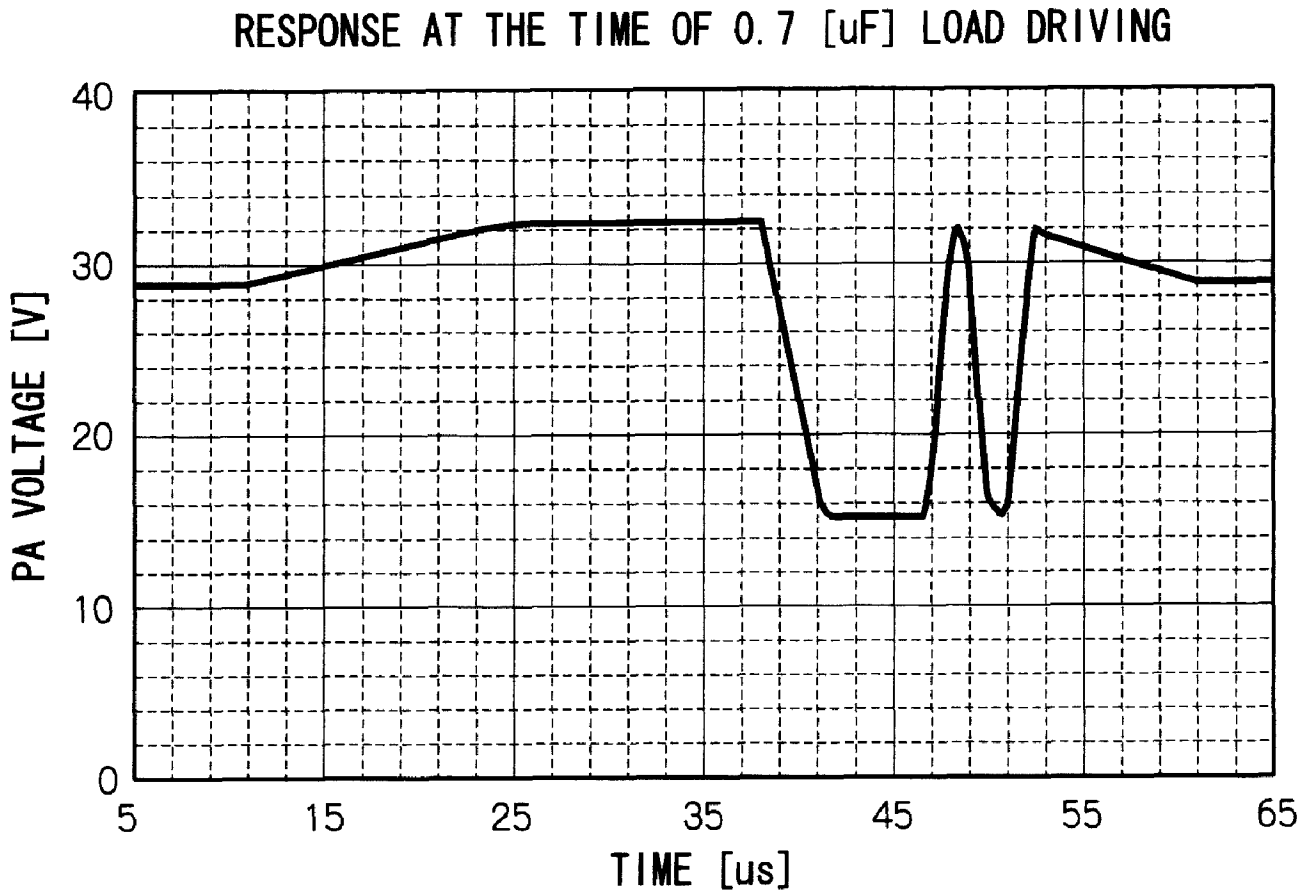
FIG. 4 is a diagram showing a driving waveform at the output terminal of the first filter at a time of 0.7 [uF] load driving which corresponds to a case of driving about 1000 piezoelectric actuators simultaneously.

FIG. 3 is a diagram showing the driving waveform at the output terminal of the first filter 14 at the time of no-load driving which corresponds to the time of driving one piezoelectric actuator. FIG. 4 is a diagram showing the driving waveform at the output terminal of the first filter 14 at the time of 0.7 [uF] load driving, which corresponds to a case of simultaneously driving about 1000 piezoelectric actuators. As shown in FIG. 3 and FIG. 4, the liquid droplet ejection device obtains a substantially uniform driving waveform, without being affected by the number of piezoelectric actuators which are driven. Accordingly, the liquid droplet ejection device can realize stable operation regardless of the number of piezoelectric actuators.

As described above, the liquid droplet ejection device of the first embodiment can cause the head 2 to eject liquid droplets, by pulse-width-modulating the error signal of the operational amplifier 11, whose gain has been adjusted by the resistor R1, the capacitor C1 and the resistor R2, digitally amplifying the signal, subjecting the signal to filtering processing, and thereafter, supplying the signal to the piezoelectric actuators $\mathbf{22}_1$ through $\mathbf{22}_n$. Further, the liquid droplet ejection device feeds back the signal after the filtering processing, to the operational amplifier 11 via the first feedback circuit 15 and the operational amplifier 17 which is an impedance converting circuit. In this way, the liquid droplet ejection device can set the gain of the operational amplifier 11 without being affected by the elements structuring the first feedback circuit 15, and as a result, can operate stably.

Further, although there is the concern that the cut-off frequency of the first filter 14 will fluctuate due to the piezoelectric actuators $\mathbf{22}_1$ through $\mathbf{22}_n$ which are capacitive loads, because the output of the first filter 14 is fed-back to the inverting input terminal of the operational amplifier 11, fluctuations in the cut-off frequency of the first filter 14 can be suppressed.

The digital voltage amplifier 13 performs a switching operation by a digital technique, and carries out voltage amplification and current amplification. Therefore, the generation of heat of the liquid droplet ejection device can be suppressed, and, even in a high-frequency band, a driving signal which has a uniform waveform can be outputted to the piezoelectric actuators $\mathbf{22}_1$ through $\mathbf{22}_n$.

Second Embodiment

A second embodiment of the present invention will be described next. Circuits which are the same as those of the first embodiment are denoted by the same reference numerals, and repeat, detailed description of circuits is omitted.

Figure 5:
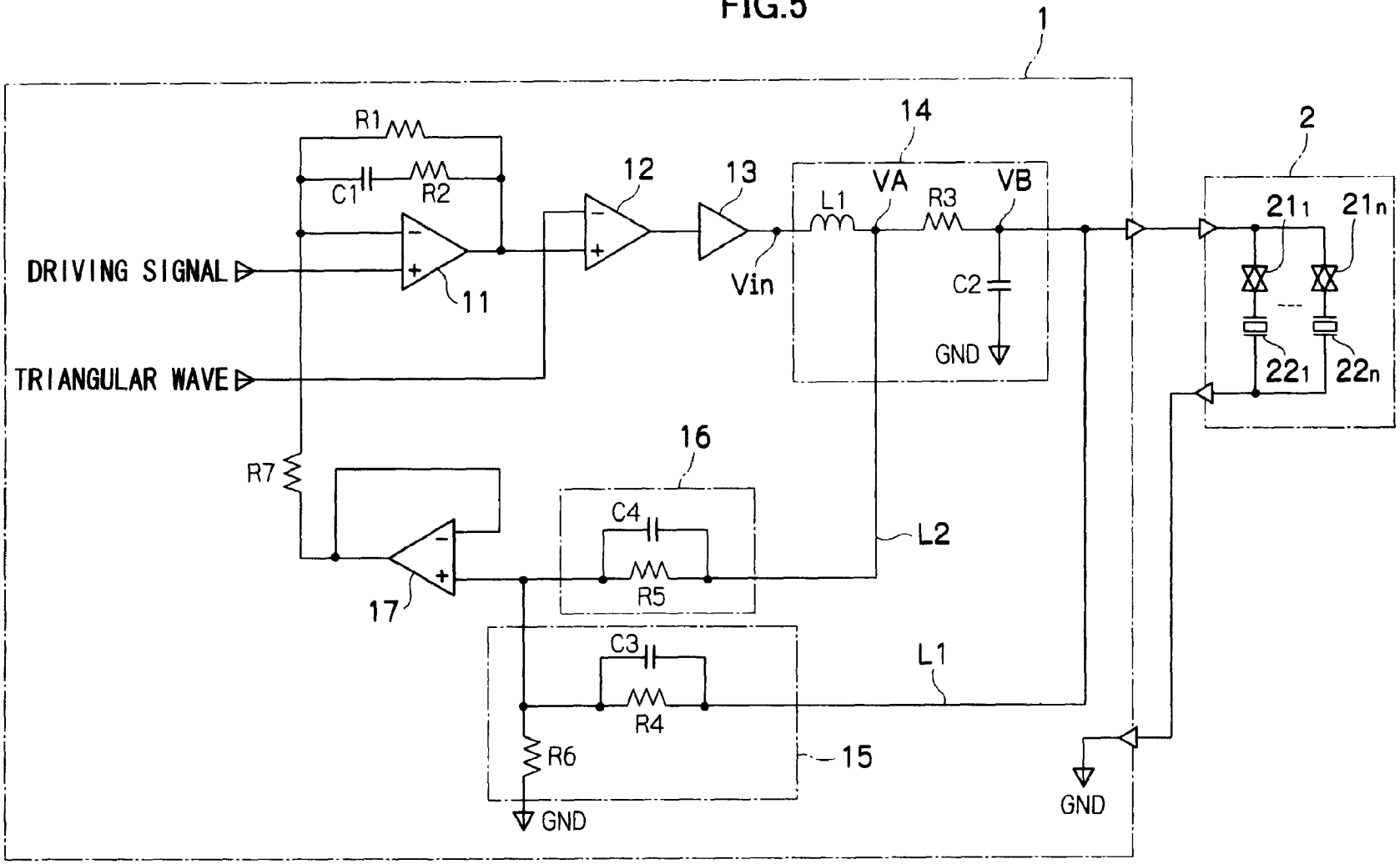
FIG. 5 is a diagram showing a circuit structure of a liquid droplet ejection device relating to a second embodiment.

FIG. 5 is a diagram showing the circuit structure of a liquid droplet ejection device relating to the second embodiment. The liquid droplet ejection device relating to the second embodiment is a device in which a second feedback circuit 16 is added to the structure shown in FIG. 1.

The second feedback circuit 16 is a parallel circuit of a capacitor C4 and a resistor R5. One end of the resistor R5 is connected to the output side of the inductor L1 of the first filter 14 (the connecting portion of the inductor L1 and the resistor R3). The other end of the resistor R5 is connected to the non-inverting input terminal of the operational amplifier 17.

Here, given that the output voltage of the digital voltage amplifier 13 is Vin, the output voltage of the inductor L1 is VB, and the output voltage of the resistor R3 is VA. Further, the feedback loop going via the first feedback circuit 15 is first feedback loop L1, and the feedback loop going via the second feedback circuit 16 is second feedback loop L2. The voltage VB is the voltage which is fed-back to the operational amplifier 11 by the second feedback loop L2. The voltage VA is the terminal voltage of the piezoelectric actuators 22, and is the voltage which is fed-back to the operational amplifier 11 by the first feedback loop L1. At this time, the gain of the voltage VA with respect to the voltage Vin is expressed by formula (1), and the gain of the voltage VB with respect to the voltage Vin is expressed by formula (2).

$$\frac{VA}{Vin} = \frac{\omega_0^2}{s^2 + 2\varsigma\omega_0 s + \omega_0^2} \quad (1)$$

$$\frac{VB}{Vin} = \frac{2\varsigma\omega_0 s}{s^2 + 2\varsigma\omega_0 s + \omega_0^2} \quad (2)$$

$$\omega_0 = \frac{1}{\sqrt{L1 \cdot C2}}$$

$$\varsigma = \frac{R3}{2}\sqrt{\frac{C2}{L1}}$$

Looking at formula (2), which expresses the primary delay element, from formula (1) which expresses the secondary delay element, formula (2) is a primary lead element with respect to formula (1). Namely, the phase of the voltage VB is more advanced than that of the voltage VA. Accordingly, due to the second feedback loop L2 adding the voltage VB to the voltage VA which is fed-back by the first feedback loop L1, the phase delay of the high-frequency band which is generated by the first feedback loop L1 can be compensated for, and operation of the first filter 14 in the high-frequency band can be stabilized.

Further, the first and second feedback loops L1, L2 feedback the voltages VA and VB to the operational amplifier 11 via the operational amplifier 17 which is an impedance converting circuit. In this way, without being affected by the elements structuring the first and second feedback circuits 15, 16, the liquid droplet ejection device can adjust the gain of the operational amplifier 11, and as a result, can operate stably.

As described above, in the liquid droplet ejection device relating to the second embodiment, the operational amplifier 17 which is an impedance converting circuit is provided at the first and second feedback loops L1, L2. In this way, without being affected by the elements structuring the first and second feedback circuits 15, 16, the liquid droplet ejection device can adjust the gain of the operational amplifier 11, and as a result, can operate stably.

Further, by taking-out the voltage VB, whose phase is more advanced than that of the voltage VA of the first feedback loop L1, from the first filter 14 and adding this voltage VB to the voltage VA, the liquid droplet ejection device compensates for the phase lag of the first filter 14 in a high-frequency band, and can make operation stable.

Third Embodiment

A third embodiment of the present invention will be described next. Circuits which are the same as those of the above-described embodiments are denoted by the same reference numerals, and repeat, detailed description of circuits is omitted.

Figure 6:
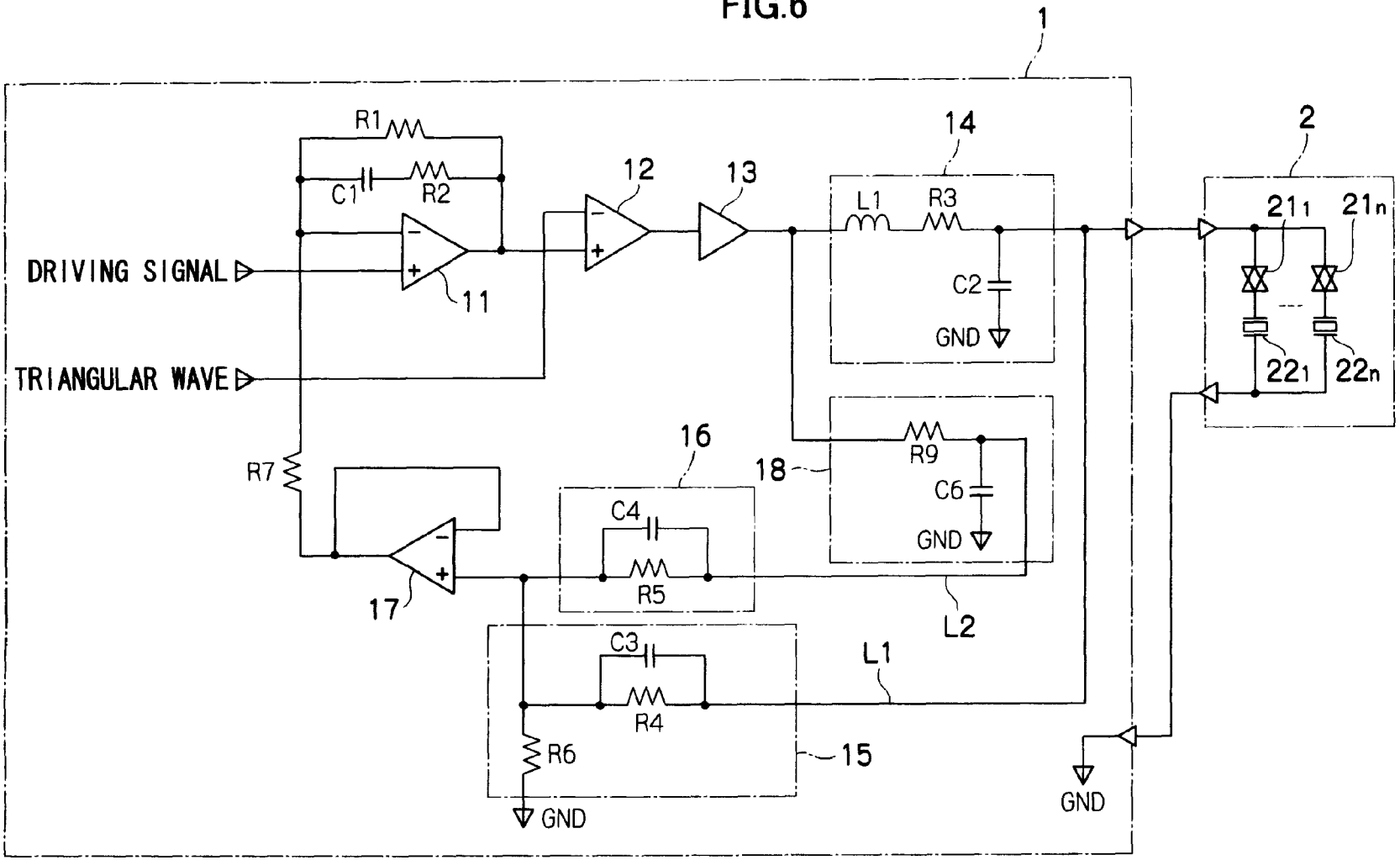
FIG. 6 is a diagram showing a circuit structure of a liquid droplet ejection device relating to a third embodiment.

FIG. 6 is a diagram showing the circuit structure of a liquid droplet ejection device relating to the third embodiment. The liquid droplet ejection device relating to the third embodiment is a device in which the second feedback circuit 16 and a second filter 18 are added to the structure shown in FIG. 1.

The structure of the second feedback circuit 16 is similar to that of the second embodiment (FIG. 5). However, one end of the resistor R5 is connected to the output terminal of the digital voltage amplifier 13 via the second filter 18. The other end of the resistor R5 is connected to the non-inverting input terminal of the operational amplifier 17.

The second filter 18 is structured by a resistor R9 and a capacitor C6. One end of the resistor R9 is connected to the output terminal of the digital voltage amplifier 13, whereas the other end is connected to the capacitor C6 and to the resistor R5 of the second feedback circuit 16. The other end of the capacitor C6 (the side which is not connected to the resistor R9) is grounded. Therefore, the second filter 18 smoothes the signal inputted to the one end of the resistor R9, and outputs the smoothed signal from the other end of the resistor R9.

Here, the second filter 18 is a primary delay element, whereas the first filter 14 is a secondary delay element. Namely, the second filter 18 is primarily advanced with respect to the first filter 14, and therefore, as seen from the first filter 14, works to advance the phase of the high-frequency band.

Accordingly, the liquid droplet ejection device relating to the third embodiment feeds-back the voltage, which is outputted from the first filter 14 which is the secondary delay element, to the operational amplifier 11 via the first feedback loop L1, and feeds-back the voltage, which is outputted from the second filter 18 which is the primary delay element, to the operational amplifier 11 via the second feedback loop L2. Because the phase delay of the high-frequency band generated by the first filter 14 can be compensated for in this way, operation can be made to be stable.

Further, in the liquid droplet ejection device, the operational amplifier 17 which is an impedance converting circuit is provided at the first and second feedback loops L1, L2. In this way, without being affected by the elements structuring the first and second feedback circuits 15, 16, the liquid droplet ejection device can set the gain of the operational amplifier 11, and as a result, can operate stably.

Fourth Embodiment

A fourth embodiment of the present invention will be described next. Circuits which are the same as those of the above-described embodiments are denoted by the same reference numerals, and repeat, detailed description of circuits is omitted.

Figure 7:
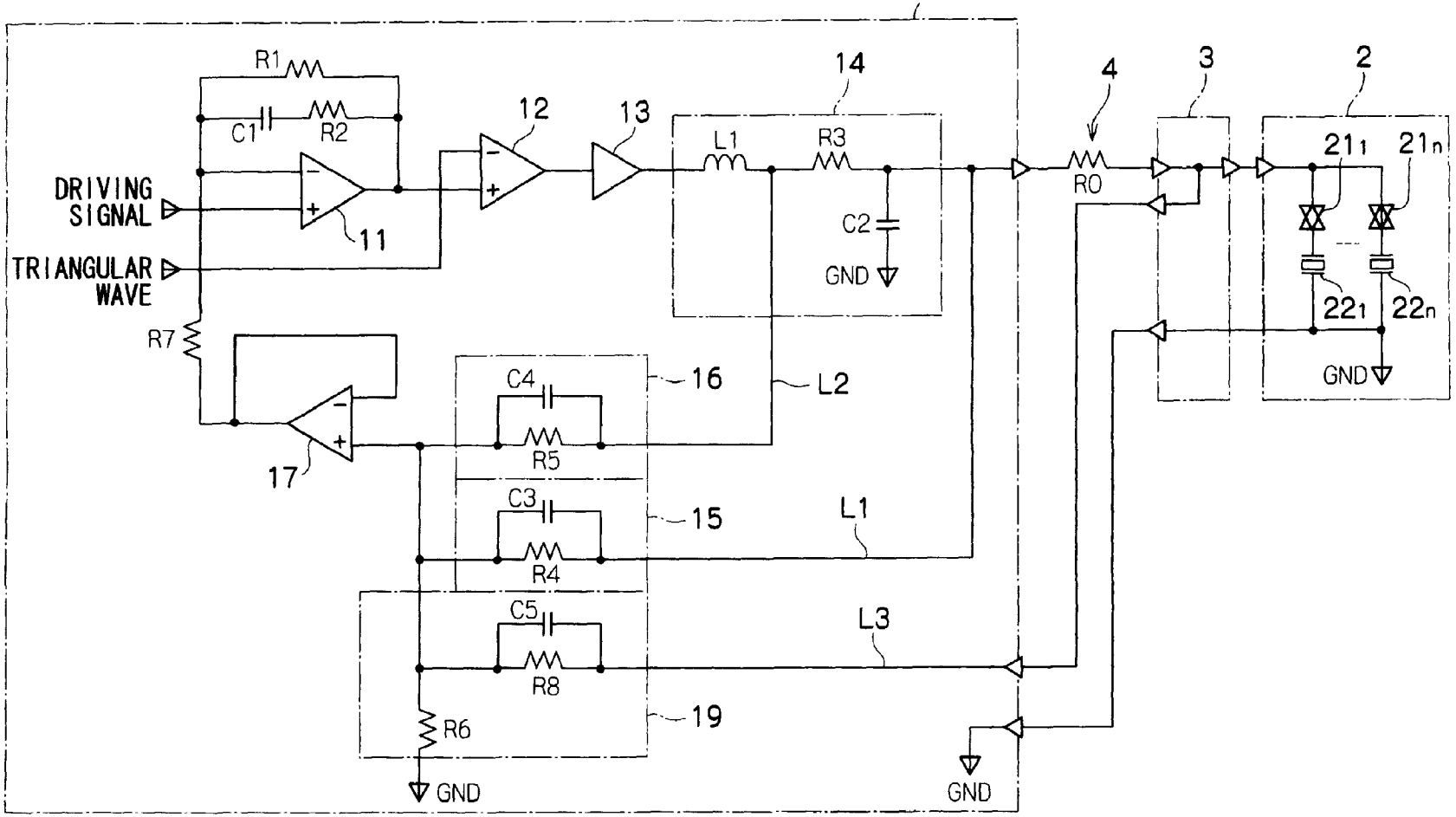
FIG. 7 is a diagram showing a circuit structure of a liquid droplet ejection device relating to a fourth embodiment.

FIG. 7 is a circuit structure diagram of a liquid droplet ejection device relating to the fourth embodiment. The liquid droplet ejection device relating to the fourth embodiment is applied in cases in which the driving circuit board 1 and the head 2 are physically located far apart, and a resistor R0 (hereinafter called "wiring resistor R0") of a cable 4 which connects the two is of a magnitude which cannot be ignored with respect to the electrostatic capacities of the piezoelectric actuators $\mathbf{22}_1$ through $\mathbf{22}_n$. Note that the head 2 is connected to the driving circuit board 1 via a relay board 3 and the cable 4.

A low-pass filter is structured by the piezoelectric actuators $\mathbf{22}_1$ through $\mathbf{22}_n$ which are capacitive loads and the wiring resistor R0. The first feedback loop L1 includes a tertiary delay element formed by the secondary delay element, which is formed by the first filter 14, and the primary delay element, which is formed by the wiring 4 and the piezoelectric actuators $\mathbf{22}_1$ through $\mathbf{22}_n$. Therefore, when the voltage outputted from the first filter 14 is fed-back via the first feedback loop L1 to the inverting input terminal of the operational amplifier 11, there is the possibility that the operation of driving the piezoelectric actuators $\mathbf{22}_1$ through $\mathbf{22}_n$ will be unstable.

Thus, the liquid droplet ejection device relating to the present embodiment has, in addition to the structure shown in FIG. 5, a third feedback circuit 19. The third feedback circuit 19 is a parallel circuit of a capacitor C5 and a resistor R8. One end of the resistor R8 is connected to the relay board 3 (the head 2 side of the wiring resistor R0), whereas the other end thereof is connected to the non-inverting input terminal of the operational amplifier 17.

A third feedback loop L3, which goes via the third feedback circuit 19, includes a tertiary delay element structured from the secondary delay element, which is formed by the first filter 14, and the primary delay element, which is formed by the wiring resistor R9 and the piezoelectric actuators 22. Further, the secondary delay element formed by the first filter 14 is included in the first feedback loop L1, and the primary delay element is included in the second feedback loop L2.

Accordingly, the liquid droplet ejection device is provided with the first feedback loop L1 which includes the secondary delay element at the inner side of the third feedback loop L3, and the second feedback loop L2 which includes the primary delay element at the inner side of the first feedback loop L1.

As described above, in the liquid droplet ejection device relating to the fourth embodiment, feedback loops, which include a phase adjusting circuit having a time constant smaller than that of the feedback loop at the outer side, are structured doubly. Therefore, the phase delay of the feedback loop at the outer side can be compensated for, and operation of the piezoelectric actuators $\mathbf{22}_1$ through $\mathbf{22}_n$ can be stabilized.

Further, the first through third feedback loops L1, L2, L3 feed-back to the operational amplifier 11 via the operational amplifier 17 which is an impedance converting circuit. In this way, without being affected by the elements structuring the first through third feedback circuits 15, 16, 19, the liquid droplet ejection device can adjust the gain of the operational amplifier 11, and as a result, can operate stably. Note that the liquid droplet ejection device may be structured as follows.

Figure 8:
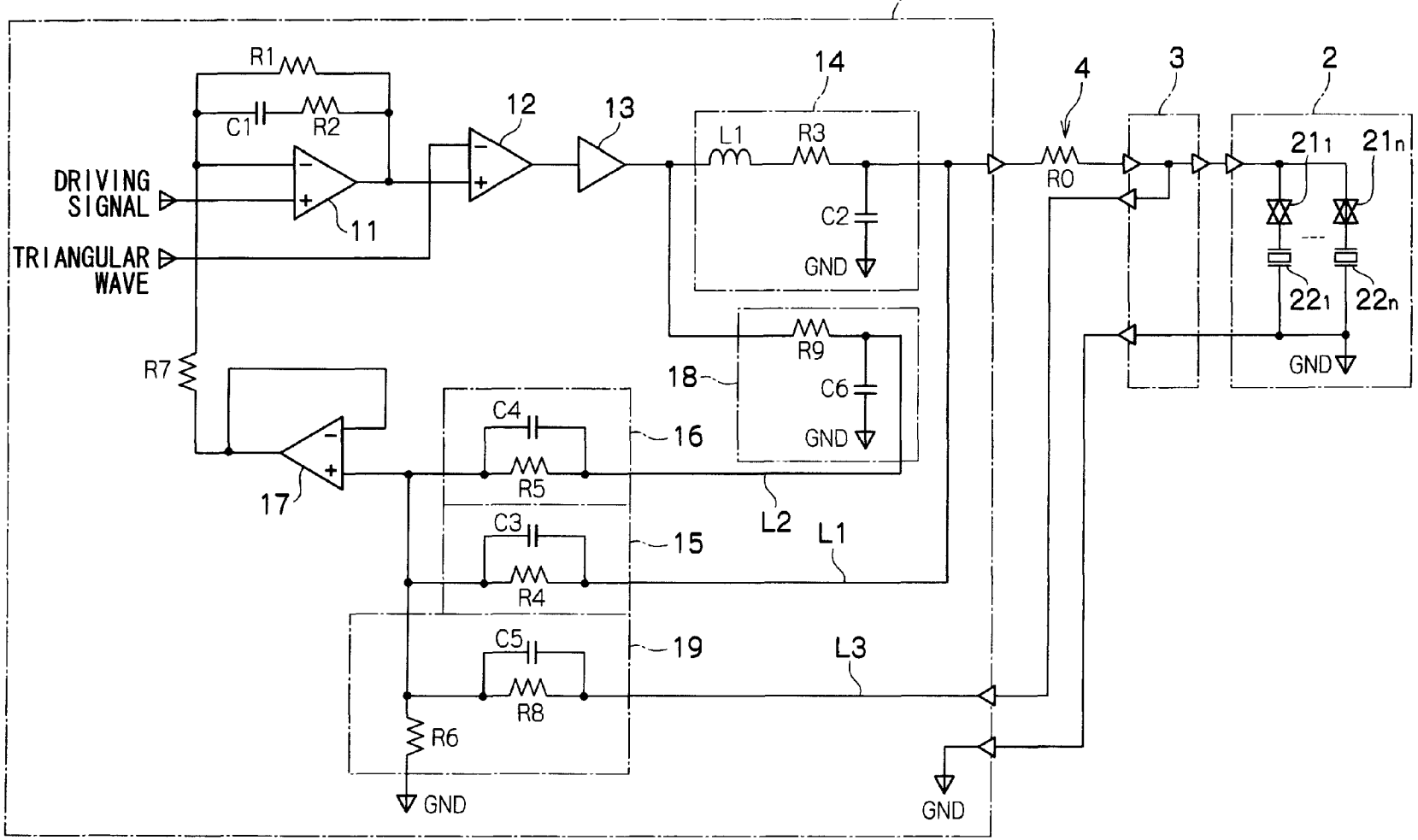
FIG. 8 is a diagram showing another circuit structure of the liquid droplet ejection device relating to the fourth embodiment.

FIG. 8 is a diagram showing another circuit structure of the liquid droplet ejection device relating to the fourth embodiment. This liquid droplet ejection device can be applied in a case in which the wiring resistor R0 between the driving circuit board 1 and the head 2 of the liquid droplet ejection device shown in FIG. 6, is of a magnitude which cannot be ignored.

The second filter 18 has a similar structure as in FIG. 6. Accordingly, the second filter 18 is a primary delay element, whereas the first filter 14 is a secondary delay element. Namely, because the second filter 18 is primarily advanced with respect to the first filter 14, as seen from the first filter 14, the second filter 18 works to advance the phase of the high-frequency band. Accordingly, in the same way as the liquid droplet ejection device shown in FIG. 7, the liquid droplet ejection device shown in FIG. 8 can make the operation of the piezoelectric actuators $\mathbf{22}_1$ through $\mathbf{22}_n$ stable.

Fifth Embodiment

A fifth embodiment of the present invention will be described next. Circuits which are the same as those of the above-described embodiments are denoted by the same reference numerals, and repeat, detailed description of circuits is omitted.

Figure 9:
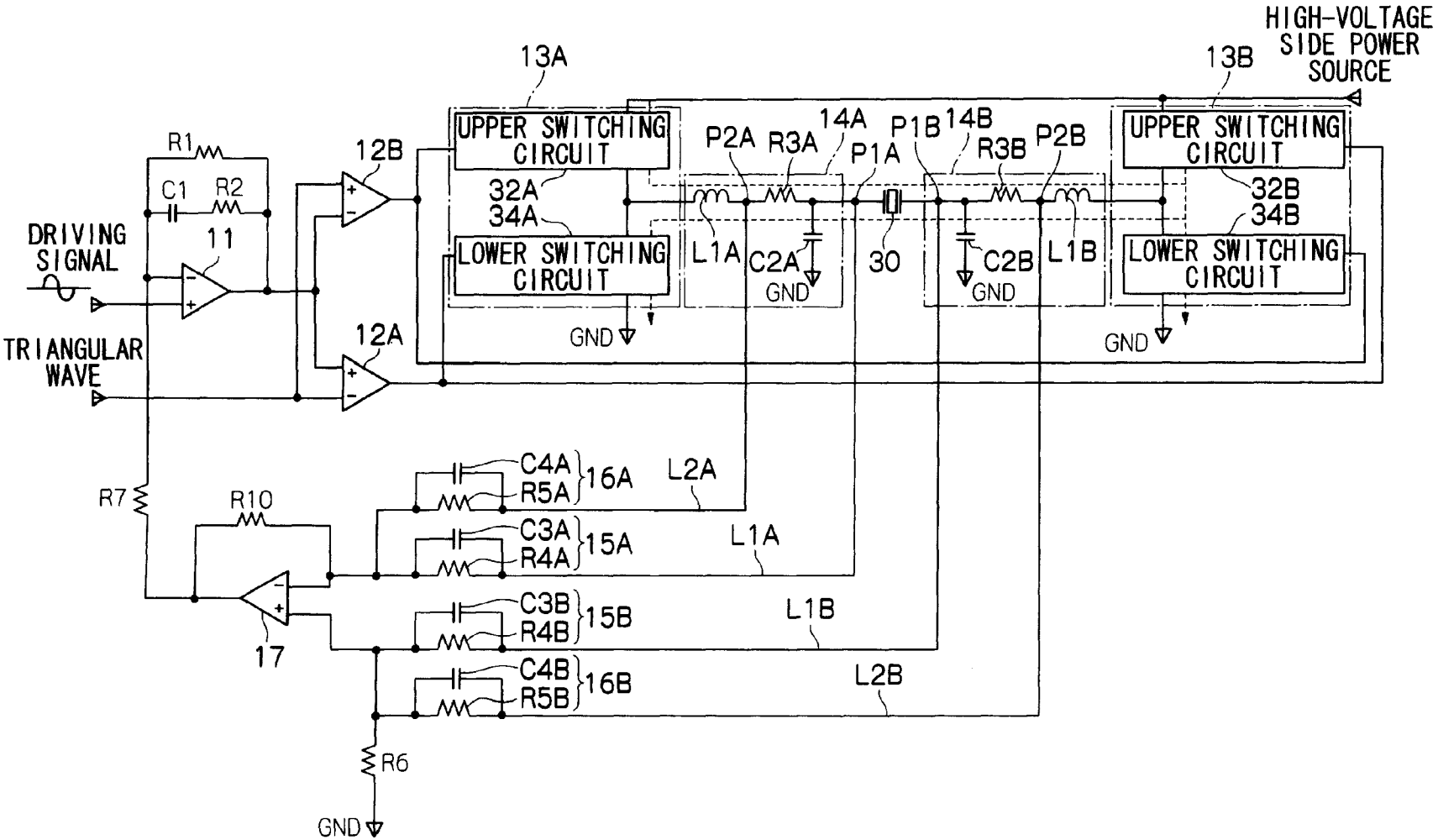
FIG. 9 is a diagram showing the circuit structure of a piezoelectric speaker driving device.

FIG. 9 is a diagram showing the circuit structure of a piezoelectric speaker driving device. Here, the piezoelectric speaker is a capacitive load, and corresponds to a piezoelectric element 30 of FIG. 9.

(Overall Structure)

The piezoelectric speaker driving device is equipped with the operational amplifier 11, comparators 12A, 12B, digital voltage amplifiers 13A, 13B, first filters 14A, 14B, first feedback circuits 15A, 15B, second feedback circuits 16A, 16B, the piezoelectric element 30, and the operational amplifier 17. The references numerals A and B which are used here represent structures which are the same but have opposite phases. Hereinafter, mainly the circuits denoted by "A" will be described.

The connection relationships between the operational amplifier 11, the resistors R1, R2, and the capacitor C1 are similar to those shown in FIG. 1. Accordingly, the gain of the operational amplifier 11 is adjusted by the resistors R1, R2 and the capacitor C1. Further, the driving signal is inputted to the non-inverting input terminal of the operational amplifier 11, and a signal which has passed through a feedback loop is inputted to the inverting input terminal thereof.

The comparators 12A, 12B have the same structure as the comparator 12 of FIG. 1. A triangular wave is inputted to the inverting input terminal of the comparator 12A and the non-inverting input terminal of the comparator 12B. The non-inverting input terminal of the comparator 12A and the inverting input terminal of the comparator 12B are connected to the output terminal of the operational comparator 11. Accordingly, the comparator 12A and the comparator 12B output signals whose phases are offset from one another by 180°.

The digital voltage amplifier 13A has an upper switching circuit 32A and a lower switching circuit 34A. The upper switching circuit 32A is on when the output voltage of the comparator 12B is high-level, and is off when then output voltage of the comparator 12B is low-level. The lower switching circuit 34A is on when the output voltage of the comparator 12A is high-level, and is off when the output voltage of the comparator 12A is low-level. The digital voltage amplifier 13B has an upper switching circuit 32B and a lower switching circuit 34B. The upper switching circuit 32B is on when the output voltage of the comparator 12A is high-level, and is off when the output voltage of the comparator 12A is low-level. The lower switching circuit 34B is on when the output voltage of the comparator 12B is high-level, and is off when the output voltage of the comparator 12B is low-level.

The first filters 14A, 14B are structured similarly to the first filter 14 shown in FIG. 1. The first filter 14A has an inductor L1A, a resistor R3A, and a capacitor C2A. One end of the inductor L1A is connected to the digital voltage amplifier 13A, whereas the other end is connected to the resistor R3A. The other end of the resistor R3A (the side which is not connected to the inductor L1A) is connected to the capacitor C2A and the piezoelectric element 30. The other end of the capacitor C2A (the side which is not connected to the resistor R3A) is grounded. Further, the connection relationship between the first filter 14B and the digital voltage amplifier 13B is similar to the connection relationship between the first filter 14A and the digital voltage amplifier 13A.

Accordingly, when the upper switching circuit 32A is turned on, high-level voltage from the high-voltage side power source is applied to the first filter 14A. When the lower switching circuit 34A is turned on, low-level (zero) voltage is applied to the first filter 14A. On the other hand, when the upper switching circuit 32B is turned on, high-level voltage from the high-voltage side power source is applied to the first filter 14B. When the lower switching circuit 34B is turned on, low-level (zero) voltage is applied to the first filter 14B.

The output terminal of the first filter 14A (a point P1A at the place where the resistor R3A and the piezoelectric element 30 are connected) is connected to the inverting input terminal of the operational amplifier 11 via the first feedback circuit 15A, the operational amplifier 17, and the resistor R7. This feedback loop is called a first feedback loop L1A. The first feedback circuit 15A is a parallel circuit of a capacitor C3A and a resistor R4A.

A point P2A, which is within the first filter 14A and which is at the place where the resistor R3A and the inductor L1A are connected, is connected to the inverting input terminal of the operational amplifier 11 via the second feedback circuit 16A, the operational amplifier 17, and the resistor R7. The second feedback circuit 16A is a parallel circuit of a capacitor C4A and a resistor RSA. This feedback loop is called a second feedback loop L2A.

A first feedback loop L1B is structured similarly to the first feedback loop L1A, and a second feedback loop L2B is structured similarly to the second feedback loop L2A.

The inverting input terminal of the operational amplifier 17 is connected to the point P1A via the first feedback circuit 15A, and is connected to the point P2A via the second feedback circuit 16A. The non-inverting input terminal of the operational amplifier 17 is connected to a point P1B via the first feedback circuit 15B, is connected to a point P2B via the second feedback circuit 16B, and is grounded via the resistor R6. The output terminal of the operational amplifier 17 is connected to the inverting input terminal via a resistor R10.

The operational amplifier 17 outputs a differentially amplified signal of signals respectively inputted to the inverting input terminal and the non-inverting input terminal, and, via the resistor R7, supplies this signal to the inverting input terminal of the operational amplifier 11. At this time, the operational amplifier 17 also functions as an impedance converting circuit, i.e., a buffer circuit.

(Operation of Piezoelectric Speaker Driving Device)

Figure 10:
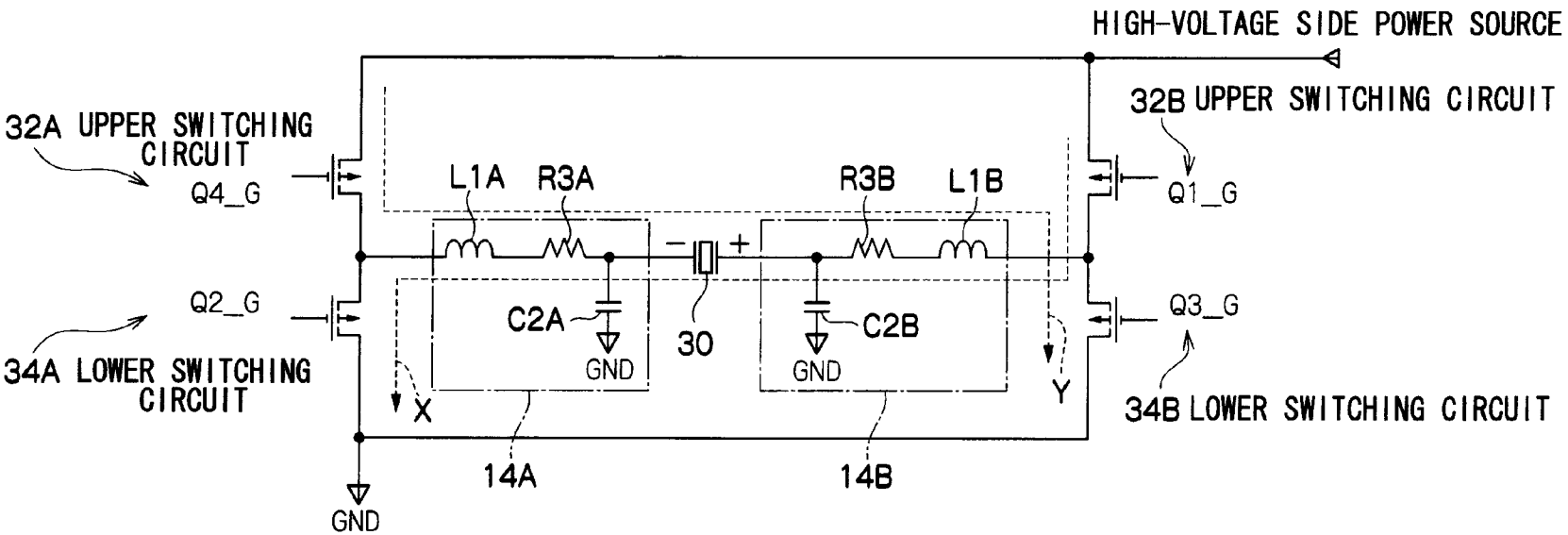
FIG. 10 is a circuit structure diagram of main portions of the piezoelectric speaker driving device.

FIG. 10 is a circuit structure diagram of main portions of the piezoelectric speaker driving device. Here, four switching circuits are schematically shown by transistors. Hereinafter, the upper switching circuit 32A is shown as transistor Q4_G, the lower switching circuit 34A is shown as transistor Q2_G, the upper switching circuit 32B is shown as transistor Q1_G, and the lower switching circuit 34B is shown as transistor Q3_G. Each transistor is on when the gate signal is high-level. Further, as for the polarity of the piezoelectric element 30, the side connected to the first filter 14B is positive.

Figure 11:
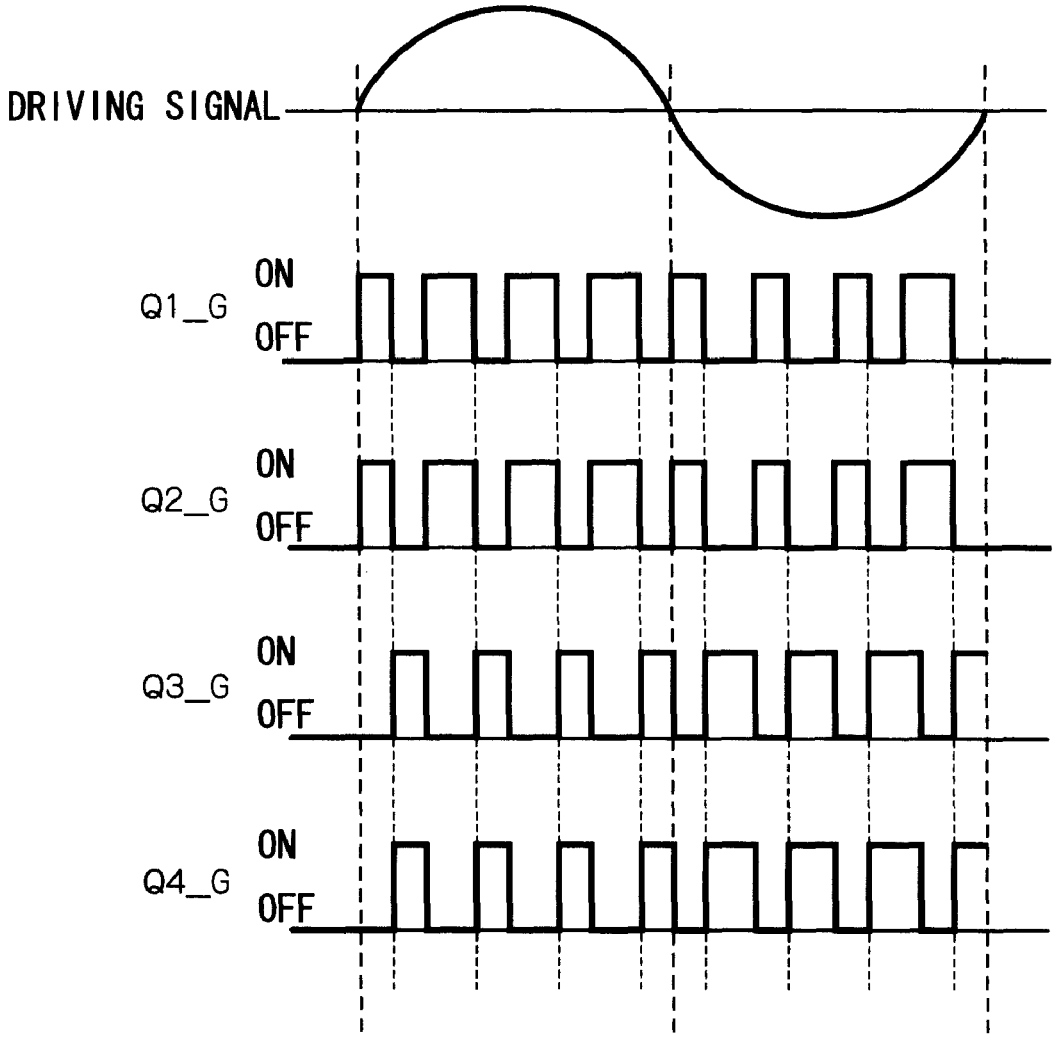
FIG. 11 is a diagram showing a driving signal inputted to an operational amplifier and gate signals of transistors Q1 to 4_G.

FIG. 11 is a diagram showing a driving signal inputted to the operational amplifier 11, and gate signals of the transistors Q1 to 4_G.

The comparator 12A outputs a pulse signal which is a duty ratio of 100% when the error signal outputted from the operational amplifier 11 is the maximum positive value, and is a duty ratio of 50% when the error signal is 0V, and is a duty ratio of 0% when the error signal is the maximum negative value. This pulse signal is supplied to the upper switching circuit 32B (transistor Q1_G) and the lower switching circuit 34A (transistor $Q^2$_G).

Conversely, the comparator 12B outputs a pulse signal which is a duty ratio of 0% when the error signal outputted from the operational amplifier 11 is the maximum positive value, and is a duty ratio of 50% when the error signal is 0V, and is a duty ratio of 100% when the error signal is the maximum negative value. This pulse signal is supplied to the upper switching circuit 32A (transistor Q4_G) and the lower switching circuit 34B (transistor Q3_G).

Accordingly, as shown in FIG. 11, when the transistors Q1_G, Q2_G are on, the transistors Q3_G, Q4_G are off, and as shown in FIG. 10, current flows along the X direction. Further, when the transistors Q1_G, Q2_G are off, the transistors Q3_G Q4_G are on, and current flows along the Y direction.

Here, when the driving voltage is positive, as shown in FIG. 11, the duty ratio of the pulse signals of the transistors Q1_G, Q2_G is greater than the duty ratio of the pulse signals of the transistors Q3_G, Q4_G. Accordingly, because the current flowing in the X direction is greater than that in the Y direction, the voltage between the terminals of the piezoelectric element 30 is positive.

When the driving voltage is zero, the duty ratio of the pulse signals of the transistors Q1_G, Q2_G is equal to the duty ratio of the pulse signals of the transistors Q3_G, Q4_G. Because the currents flowing in the X direction and the Y direction are equal, the voltage between the terminals of the piezoelectric element 30 is zero.

When the driving voltage is negative, the current flowing in the Y direction is greater than that in the X direction, and therefore, the voltage between the terminals of the piezoelectric element 30 is negative. In this way, each time the voltage of the driving signal reverses from positive to negative or vice-versa, the polarity of the piezoelectric element 30 is also reversed.

The operational amplifier 17, via the first feedback loops L1A, L1B, outputs a differentially amplified signal of the terminal voltages of both ends of the piezoelectric element 30, and causes this signal to be fed-back to the inverting input terminal of the operational amplifier 11. Accordingly, fluctuations in the cut-off frequency of the first filter 14 can be suppressed, while taking into consideration the state of the polarity of the piezoelectric element 30.

Further, the operational amplifier 17, via the second feedback loops L2A, L2B, outputs a differentially amplified signal of the voltage at the point P2A of the first filter 14A and the voltage at the point P2B of the first filter 14B, and causes this signal to be fed-back to the inverting input terminal of the operational amplifier 11.

Accordingly, the operational amplifier 17 adds, to the differentially amplified signal of the first feedback loops L1A, L1B, the differentially amplified signal of the second feedback loops L2A, L2B whose phase is more advanced than that of the differentially amplified signal of the first feedback loops L1A, L1B. In this way, while taking the state of the polarity of the piezoelectric element 30 into consideration, the operational amplifier 17 compensates for the phase lag of the first filters 14A, 14B in the high-frequency band, and can make operation stable. Further, the operational amplifier 17 also functions as a buffer circuit. Accordingly, without being affected by the elements respectively structuring the first feedback circuits 15A, 15B and the second feedback circuits 16A, 16B, the operational amplifier 17 can adjust the gain of the operational amplifier 11, and as a result, can operate stably.

As described above, the piezoelectric speaker driving device relating to the present embodiment adds, to the differentially amplified signal of the first feedback loops L1A, L1B, the differentially amplified signal of the second feedback loops L2A, L2B whose phase is more advanced than that of the differentially amplified signal of the first feedback loops L1A, L1B. In this way, while taking the state of the polarity of the piezoelectric element 30 into consideration, the piezoelectric speaker driving device compensates for the phase lag of the first filters 14A, 14B in the high-frequency band, and can make operation stable.

As described above, the present invention can stably drive a capacitive load, while keeping the packaging surface area of a driving circuit in check.

Note that the present invention is not limited to the above-described embodiments, and can, of course, also be applied to structures which are modified in terms of design within the scope recited in the claims.

A first aspect of the present invention provides a capacitive load driving circuit which applies a driving signal to a capacitive load and drives the capacitive load, the capacitive load driving circuit including: an operational amplifier outputting a difference signal of a signal inputted to an inverting input terminal and an analog driving signal inputted to a non-inverting input terminal, and setting a loop gain; a pulse width modulator pulse-width-modulating the difference signal outputted by the operational amplifier, and outputting resultant digital signal; a digital voltage amplifier amplifying a voltage of the digital signal; a first filter smoothing a digital signal outputted by the digital voltage amplifier, and supplying a smoothed signal to the capacitive load as the driving signal; an impedance converting circuit converting an impedance of an output signal of the first filter; and a first feedback circuit feeding-back the driving signal, which is outputted from the first filter, to the inverting input terminal of the operational amplifier via the impedance converting circuit.

The digital voltage amplifier amplifies the voltage of the digital signal which was pulse-width-modulated by the pulse width modulator. Therefore, because the generation of heat can be suppressed, the packaging surface area can be held in check. Further, the digital signal outputted from the digital voltage amplifier is supplied to the capacitive load via the first filter, and is fed-back to the operational amplifier via the first feedback circuit and the impedance converting circuit. Here, the impedance converting circuit is a buffer circuit whose gain is 1. Accordingly, the loop gain set by the operational amplifier is not affected in any way by the first feedback circuit.

Accordingly, the above-described invention can stably drive a capacitive load while keeping the packaging surface area in check. Moreover, the present invention can be applied as well to a capacitive load driving method as a second aspect.

A third aspect of the present invention provides a liquid droplet ejection device having a liquid droplet ejection head which includes a plurality of pressure generating chambers filled with liquid droplets to be ejected from nozzles, and a plurality of piezoelectric elements provided so as to correspond to the respective pressure generating chambers, the liquid droplet ejection device causing liquid droplets to be ejected from the pressure generating chambers by applying a driving signal to the piezoelectric elements and deforming capacities of the pressure generating chambers, the liquid droplet ejection device including: a piezoelectric element driving circuit, the driving circuit including: an operational amplifier outputting a difference signal of a signal inputted to an inverting input terminal and an analog driving signal inputted to a non-inverting input terminal, and setting a loop gain; a pulse width modulator pulse-width-modulating the difference signal outputted by the operational amplifier, and outputting a digital signal; a digital voltage amplifier amplifying a voltage of the digital signal; a first filter smoothing a digital signal outputted by the digital voltage amplifier, and supplying a smoothed signal to the piezoelectric elements as the driving signal; an impedance converting circuit converting an impedance of an inputted signal; and a first feedback circuit feeding-back the driving signal, which is outputted from the first filter, to the inverting input terminal of the operational amplifier via the impedance converting circuit.

The above-described invention can stably eject liquid droplets which are filled in pressure generating chambers, by stably driving the piezoelectric elements while keeping the packaging surface area in check.

A fourth aspect of the present invention provides a piezoelectric speaker driving device applying a driving signal to a piezoelectric speaker and driving the piezoelectric speaker, the piezoelectric speaker driving device including: an operational amplifier outputting a difference signal of a signal inputted to an inverting input terminal and an analog driving signal inputted to a non-inverting input terminal, and setting a loop gain; a first pulse width modulator pulse-width-modulating the difference signal outputted by the operational amplifier, and outputting resultant digital signal; a first digital voltage amplifier amplifying a voltage of the digital signal outputted from the first pulse width modulator; a first filter smoothing a digital signal outputted by the first digital voltage amplifier, and supplying a smoothed signal to one polarity of the piezoelectric speaker as a first driving signal; a second pulse width modulator pulse-width-modulating an inverted signal of the difference signal outputted by the operational amplifier, and outputting resultant digital signal; a second digital voltage amplifier amplifying a voltage of the digital signal outputted from the second pulse width modulator; a second filter smoothing a digital signal outputted by the second digital voltage amplifier, and supplying a smoothed signal to another polarity of the piezoelectric speaker as a second driving signal; and a differential amplifier outputting a differential amplification of the first and second driving signals outputted from the first and second filters, and supplying it to the inverting input terminal of the operational amplifier.

The first and second digital voltage amplifiers amplify the voltages of the digital signals which have been pulse-width-modulated by the pulse width modulators. Therefore, because the generation of heat can be suppressed, the packaging surface area can be held in check.

The first driving signal outputted from the first filter is supplied to one polarity of the piezoelectric speaker. The second driving signal outputted from the second filter is supplied to the other polarity. The differential amplifier not only functions as an impedance converting circuit, but also outputs the differential amplification of the first and second driving signals outputted from the first and second filters, and supplies it to the inverting input terminal of the operational amplifier. Accordingly, the differential amplifier feeds-back, to the inverting input terminal of the operational amplifier, a signal which takes into consideration the state of the polarity of the voltage applied to the piezoelectric speaker.

Accordingly, the above-described invention is provided with the differential amplifier which outputs the differential amplification of the first and second driving signals outputted from the first and second filters, and supplies it to the inverting input terminal of the operational amplifier. This invention can thereby stably drive a piezoelectric speaker, while keeping the packaging surface area in check.

What is claimed is:

1. A piezoelectric speaker driving device applying a driving signal to a piezoelectric speaker and driving the piezoelectric speaker, the piezoelectric speaker driving device comprising:

an operational amplifier outputting a difference signal of a signal inputted to an inverting input terminal and an analog driving signal inputted to a non-inverting input terminal, and setting a loop gain;

a first pulse width modulator pulse-width-modulating the difference signal outputted by the operational amplifier, and outputting resultant digital signal;

a first digital voltage amplifier amplifying a voltage of the digital signal outputted from the first pulse width modulator;

a first filter smoothing a digital signal outputted by the first digital voltage amplifier, and supplying a smoothed signal to one polarity of the piezoelectric speaker as a first driving signal;

a second pulse width modulator pulse-width-modulating an inverted signal of the difference signal outputted by the operational amplifier, and outputting resultant digital signal;

a second digital voltage amplifier amplifying a voltage of the digital signal outputted from the second pulse width modulator;

a second filter smoothing a digital signal outputted by the second digital voltage amplifier, and supplying a smoothed signal to another polarity of the piezoelectric speaker as a second driving signal; and a differential amplifier outputting a differential amplification of the first and second driving signals outputted from the first and second filters, and supplying it to the inverting input terminal of the operational amplifier.

2. The piezoelectric speaker driving device of claim 1, wherein the differential amplifier amplifies a difference between a signal, which is a signal outputted from the first digital voltage amplifier and whose phase is more advanced than that of the first driving signal, and a signal, which is a signal outputted from the second digital voltage amplifier and whose phase is more advanced than that of the second driving signal, and further outputs resultant amplified difference.

3. The piezoelectric speaker driving device of claim 1, further comprising a first feedback circuit which feeds-back the first driving signal outputted from the first filter, to the inverting input terminal of the operational amplifier via the differential amplifier.

4. The piezoelectric speaker driving device of claim 1, further comprising a second feedback circuit which feeds-back, via the differential amplifier to the inverting input terminal of the operational amplifier, a signal which is a signal outputted from the first digital voltage amplifier and whose phase is more advanced than that of the first driving signal.

5. The piezoelectric speaker driving device of claim 1, further comprising a third feedback circuit which feeds-back the second driving signal outputted from the second filter, to the inverting input terminal of the operational amplifier via the differential amplifier.

6. The piezoelectric speaker driving device of claim 1, further comprising a fourth feedback circuit which feeds-back, via the differential amplifier to the inverting input terminal of the operational amplifier, a signal which is a signal outputted from the second digital voltage amplifier and whose phase is more advanced than that of the second driving signal.

* * * * *